US010856667B2

(12) United States Patent
Mazzeo et al.

(10) Patent No.: US 10,856,667 B2
(45) Date of Patent: Dec. 8, 2020

(54) BED SAFETY RAIL

(71) Applicants: Lisa Mazzeo, Beaufort, SC (US); Howard Graham, Beaufort, SC (US)

(72) Inventors: Lisa Mazzeo, Beaufort, SC (US); Howard Graham, Beaufort, SC (US)

( * ) Notice: Subject to any disclaimer, the term of this patent is extended or adjusted under 35 U.S.C. 154(b) by 379 days.

(21) Appl. No.: 15/661,487

(22) Filed: Jul. 27, 2017

(65) Prior Publication Data

US 2018/0027982 A1 Feb. 1, 2018

Related U.S. Application Data

(60) Provisional application No. 62/367,398, filed on Jul. 27, 2016.

(51) Int. Cl.

| | |
|---|---|
| ***A47C 21/08*** | (2006.01) |
| ***A47C 21/00*** | (2006.01) |
| ***H01R 24/76*** | (2011.01) |
| *H01R 25/00* | (2006.01) |

(52) U.S. Cl.

CPC ..... *A47C 21/08* (2013.01); *A47C 21/003* (2013.01); *H01R 24/76* (2013.01); *H01R 25/006* (2013.01)

(58) Field of Classification Search

CPC ..... A47C 21/00; A47C 21/003; A47C 21/08
See application file for complete search history.

(56) References Cited

U.S. PATENT DOCUMENTS

| | | | | |
|---|---|---|---|---|
| 2,359,895 A | | 7/1943 | Burton | |
| 2,797,973 A | | 7/1957 | Culpepper | |
| 3,008,534 A | | 11/1961 | Von Canon | |
| 4,008,808 A | * | 2/1977 | Ramsay | A47K 1/09 211/65 |
| 4,189,796 A | | 2/1980 | Gutner | |
| 4,221,012 A | | 9/1980 | Harris | |
| 4,332,042 A | * | 6/1982 | Koncelik | A47C 19/022 362/130 |
| 4,685,255 A | * | 8/1987 | Kelley | A47B 21/06 174/495 |

(Continued)

OTHER PUBLICATIONS

A "Custom Bunk Bed Rail"; Possible Disclosure Date: Before Apr. 18, 2016; viewable from: http://www.modmyrv.com/wp-content/gallery/mod-44-image-gallery/bunk-bed-rails-custom-3.jpg.

(Continued)

*Primary Examiner* — Peter M. Cuomo
*Assistant Examiner* — Ifeolu A Adeboyejo
(74) *Attorney, Agent, or Firm* — Eric Kelly

(57) ABSTRACT

Bed safety rails with added structures for added functionality are shown and described. The added structures may provide additional functionality, aside from safety and security, of electrical power access, a shelf, a cup-holder, a writing-implement-holder, a light-source, a dry erase board, and/or a magnet board for a given bed safety rail. A given bed safety rail may include at least one vertical-safety-rail-member and at least one horizontal-anchor-member that is attached to the vertical-safety-rail-member. The at least one vertical-safety-rail-member may provide the safety and security features; as well as the additional functional features. The at least one horizontal-anchor-member may have structure permitting the given bed safety rail to be removably anchored to a given bed.

19 Claims, 20 Drawing Sheets

(56) References Cited

U.S. PATENT DOCUMENTS 4,811,435 A * 3/1989 Foster ..... A61G 7/05 5/600
4,947,298 A 8/1990 Stephen
D324,810 S * 3/1992 Moye, Sr. ..... D3/218
5,175,897 A * 1/1993 Marra, Jr. ..... A61G 7/05 5/425
5,359,741 A 11/1994 Lang
5,555,686 A * 9/1996 Bird ..... H02G 3/288 174/480
5,651,152 A * 7/1997 Ritchie ..... A47C 21/00 294/143
5,839,240 A * 11/1998 Elsholz ..... E04B 2/7433 52/242
D401,839 S 12/1998 Krey
6,223,363 B1 5/2001 Sumlin
6,240,580 B1 * 6/2001 Hamilton ..... A61G 7/0507 297/411.2
6,289,539 B1 * 9/2001 Alpern ..... A47C 21/08 5/659
D482,921 S 12/2003 Whie
6,748,874 B2 6/2004 Gawronski
7,007,321 B2 3/2006 Polevoy
7,051,384 B1 5/2006 Guillot
7,111,341 B2 9/2006 Hennings
7,962,979 B1 * 6/2011 Hime ..... A61G 7/05 5/424
7,987,538 B1 * 8/2011 Kimball ..... A47C 21/00 5/424
RE43,193 E * 2/2012 Osborne ..... A47C 19/045 5/600
8,136,180 B2 3/2012 Leng
8,177,065 B1 * 5/2012 Thomas ..... A47C 19/22 206/376
8,297,205 B2 10/2012 Kauffman
8,578,528 B1 * 11/2013 Heare ..... A47C 21/00 108/49
8,683,626 B1 * 4/2014 Kaczmarek ..... A61G 7/015 5/503.1
9,027,900 B2 5/2015 Prohofsky
9,427,088 B2 * 8/2016 Miller ..... A61G 7/0507
2002/0017066 A1 * 2/2002 Marshall ..... A47B 83/001 52/220.2
2002/0095840 A1 * 7/2002 Seiber ..... G09F 7/18 40/606.15
2004/0020137 A1 * 2/2004 Battey ..... E04B 2/7425 52/36.1
2011/0197519 A1 * 8/2011 Henriott ..... A47B 46/005 52/36.1
2011/0247135 A1 * 10/2011 Herman ..... A61G 7/0507 5/425
2012/0266544 A1 10/2012 Lazarovits
2013/0314866 A1 11/2013 Millman
2015/0104779 A1 * 4/2015 Kingston ..... B43L 1/008 434/409
2018/0166835 A1 * 6/2018 Byrne ..... A47C 21/003

OTHER PUBLICATIONS

A "Bunk Bed Rail"; Possible Disclosure Date: Before Apr. 18, 2016; viewable from: https://s-media-cache-ak0.pinimg.com/236x/ac/1a/58/ac1a58eb3b372470f381253ba548b27f.jpg.

* cited by examiner

BED SAFETY RAIL

PRIORITY NOTICE

The present application claims priority under 35 U.S.C. § 119(e) to U.S. Provisional Patent Application Ser. No. 62/367,398 filed on Jul. 27, 2016, the disclosure of which is incorporated herein by reference in its entirety.

TECHNICAL FIELD OF THE INVENTION

The present invention relates in general to bed safety rails and more specifically to bed safety rails with added functionality, such as structures for providing electrical power, shelfing, cup-holders, writing-implement holders, light sources, dry erase boards, and/or magnet boards, to a given bed safety rail.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Too often people are injured from unintentionally falling out of beds, particularly bunk beds and other types of raised beds, such as loft beds. And such incidents are not limited to children. For example, use of bunk beds and other raised beds are common in dormitory housing, such as with colleges and universities. Even adult students can and do suffer injuries, sometimes severe, from such unintended falls out of bunk beds or other types of raised beds.

These injuries also often lead to expensive and time consuming litigation. It is clearly desirable to reduce and/or eliminate such unintended falls from beds.

While new bunk beds and new raised beds may be acquired that include an already included safety rail; a great majority of bunk beds and raised beds that are already presently in use do not have such a safety rail feature. It would be less expensive to retrofit such existing bunk beds and raised beds with a bed safety rail versus purchasing new bunk beds and new raised beds with incorporated safety rail features.

There then is a need in the art for a bed safety rail that may be fitted to existing beds, existing bunk beds, and existing raised beds that do not an incorporated safety rail feature.

Additionally, aside from main functions of providing safety and a sense of security, it may be desirable if such bed safety rails also included other features, such as, but not limited to, providing a source of electrical power near to the given bed; providing shelfing near to the given bed; providing a cup-holder near to the given bed; providing a writing-implement-holder near to the given bed; providing a location to write notes, as in the form of a dry erase board near to the given bed; and/or providing a magnet board near to the bed; wherein near to the bed may be within an arm's reach of a user of the bed, while the user is in bed.

It is to these ends that the present invention has been developed.

BRIEF SUMMARY OF THE INVENTION

To minimize the limitations in the prior art, and to minimize other limitations that will be apparent upon reading and understanding the present specification, embodiments of the present invention may describe bed safety rails with added structures for added functionality. The added structures may provide additional functionality, aside from safety and security, of one or more of: electrical power access, a shelf, a cup-holder, a writing-implement-holder, a light-source, a dry erase board, and/or a magnet board—for a given bed safety rail. A given bed safety rail may comprise at least one vertical-safety-rail-member and at least one horizontal-anchor-member that may be attached to the vertical-safety-rail-member. In some embodiments, the at least one vertical-safety-rail-member may provide the safety and security features of a rail; as well as may provide for the additional functional features. The at least one horizontal-anchor-member may have structure permitting the given bed safety rail to be removably anchored to a given bed.

It is an objective of the present invention to provide a bed safety rail that minimizes or prevents unintended falls of a bed occupant out of a bed, particularly of bunk beds or other raised beds.

It is another objective of the present invention provide a bed safety rail that is removable from the given bed.

It is another objective of the present invention provide a bed safety rail that is sufficiently strong; yet, comparably lightweight so as to be holdable by a single person.

It is another objective of the present invention to provide a bed safety rail that is easy to manufacture.

It is another objective of the present invention to provide a bed safety rail that is relatively inexpensive to manufacture.

It is another objective of the present invention to provide a bed safety rail that is manufactured efficiently.

It is another objective of the present invention to provide a bed safety rail that is shipped and/or stored efficiently; such as in a predominantly flat configuration.

It is another objective of the present invention to provide a bed safety rail that has incorporated electrical wiring so that various electronic devices may be powered and/or charged in close proximity to the bed and/or to the bed safety rail.

It is another objective of the present invention to provide a bed safety rail that has one or more trays or shelves to support and/or hold various articles, so such articles may be in close proximity to the bed and/or the bed safety rail.

It is another objective of the present invention to provide a bed safety rail that has one or more light-sources in close proximity to the bed and/or the bed safety rail.

It is another objective of the present invention to provide a bed safety rail that has various and predetermined accessory functionality.

It is another objective of the present invention to provide a bed safety rail that has a removable cup-holder.

It is another objective of the present invention to provide a bed safety rail that has a removable writing-implement-holder It is another objective of the present invention to provide a bed safety rail that has portions which may be used as a dry erase board.

It is another objective of the present invention to provide a bed safety rail that has portions which may be used as a magnet board, such that magnets may be removably attached to these portions, to hold notes and/or reminders.

It is another objective of the present invention to provide a bed safety rail that has one or more speakers in close proximity to the bed.

It is another objective of the present invention to provide a bed safety rail that has one or more microphones in close proximity to the bed.

It is yet another objective of the present invention to provide a bed safety rail that has wireless communication module to facilitate wireless communication between speakers and/or microphones of the bed safety rail and a computing device of the bed occupant.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

REFERENCE NUMERALS

Figure 1A:
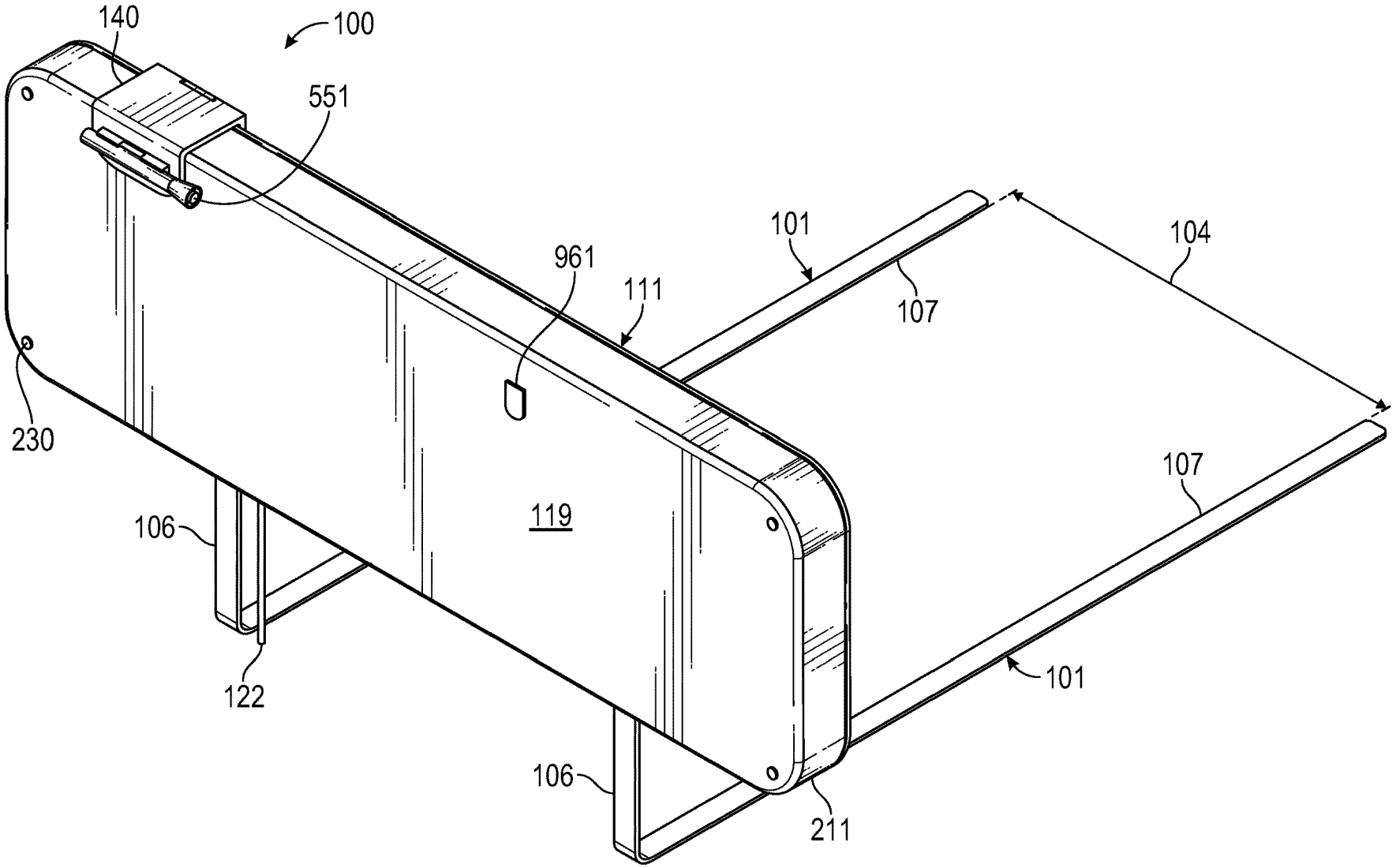
FIG. 1A may depict an overall assembled bed safety rail, shown from a top and rear perspective view.

100 bed safety rail 100
101 horizontal-anchor-member 101
104 spacing 104
105 length 105
106 vertical-portion 106
107 horizontal-portion 107
111 vertical-safety-rail-member 111
114 width 114
115 height 115
116 thickness 116
118 front-panel 118
119 rear-panel 119
120 electronics-module 120
121 connector 121
122 power-cord 122
140 clip 140
141 clip-accessory 141
211 vertical-frame-member 211
220 electronics-module-cutout 220
230 fastener 230
240 seat-fastener 240
241 bracket 241
242 power-cord-hole 242
440 receiving-channel 440
540 wedge-for-receiving-channel 540
550 writing-implement-holder 550
551 writing-implement 551
641 shelf 641
642 light source 642
806 receiving-slot 806
842 seat-fastener-receiving-hole 842
961 magnet 961

DETAILED DESCRIPTION OF THE INVENTION

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

Figure 1B:
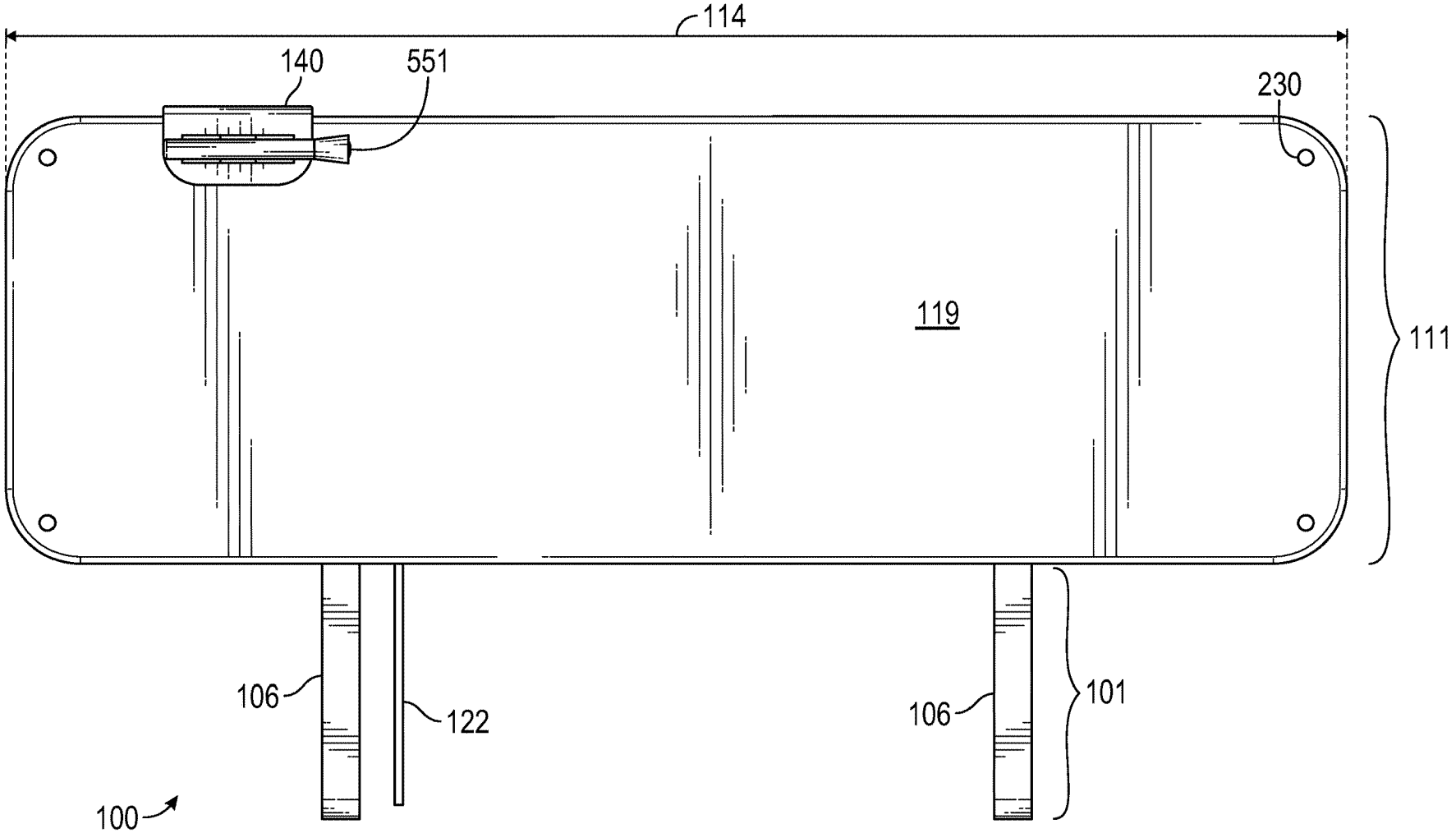
FIG. 1B may depict the assembled bed safety rail of FIG. 1A, but shown from a rear (back) view.
Figure 1C:
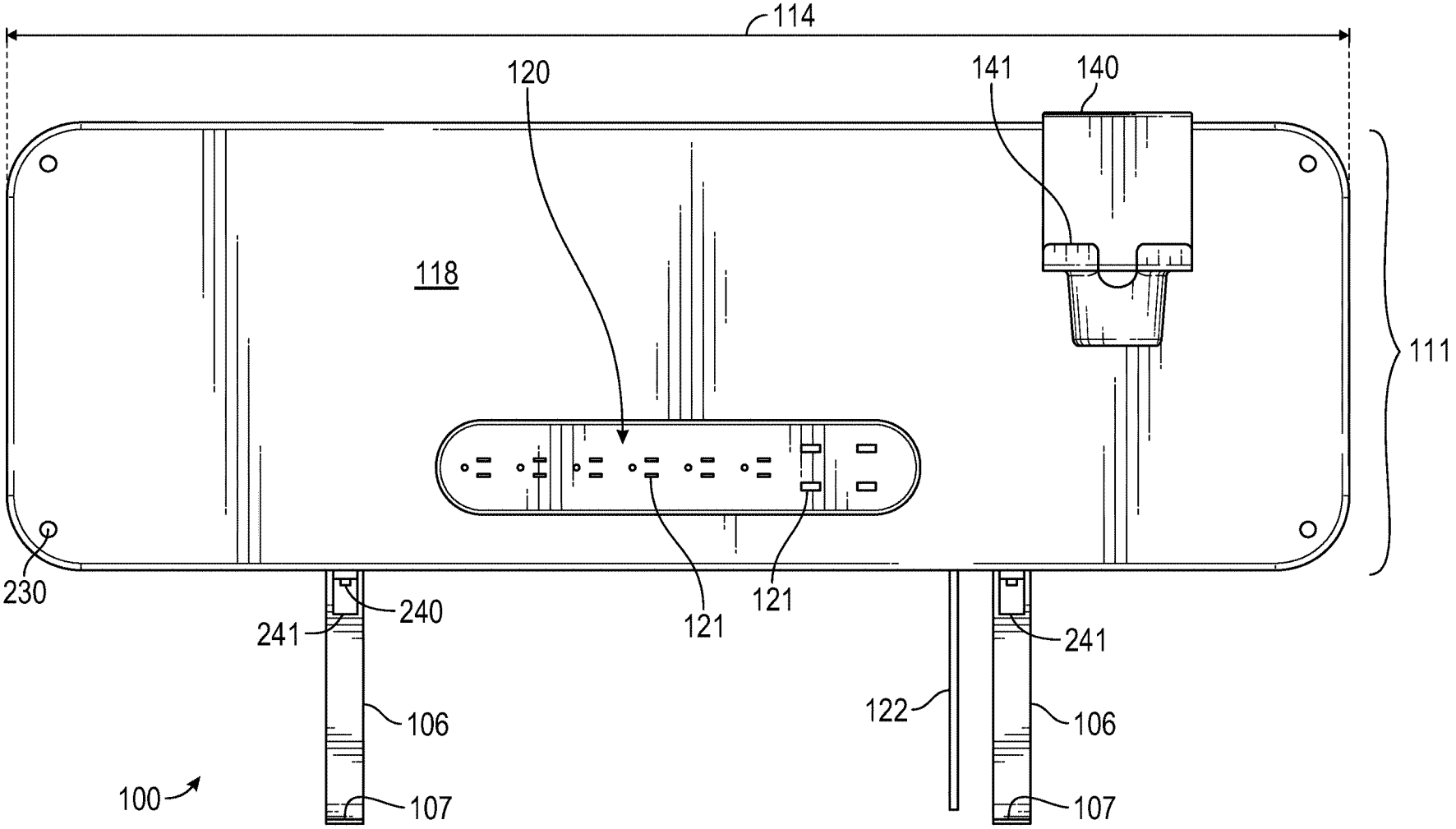
FIG. 1C may depict the assembled bed safety rail of FIG. 1A, but shown from a front view.
Figure 1D:
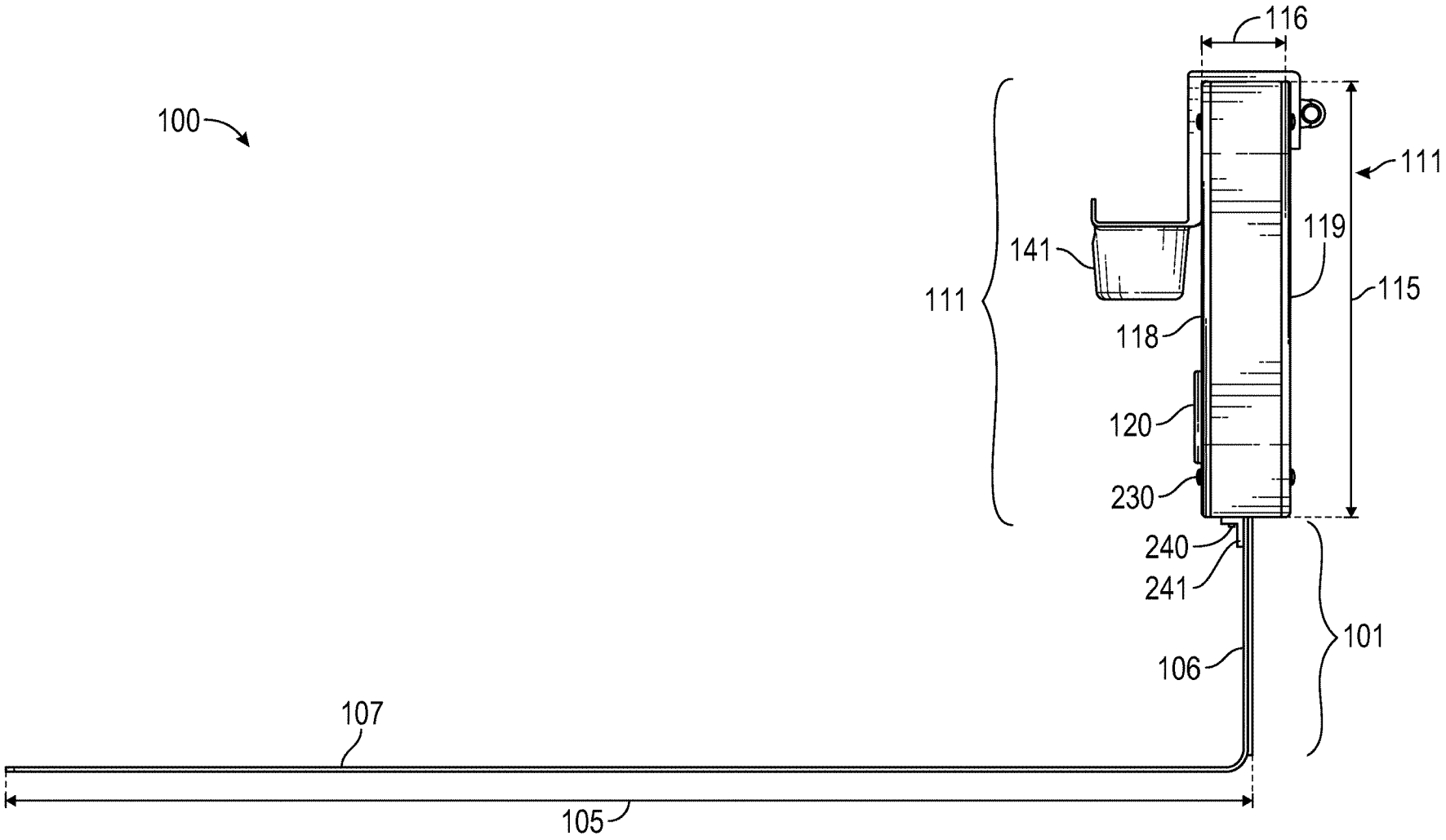
FIG. 1D may depict the assembled bed safety rail of FIG. 1A, but shown from a right-side view.
Figure 1E:
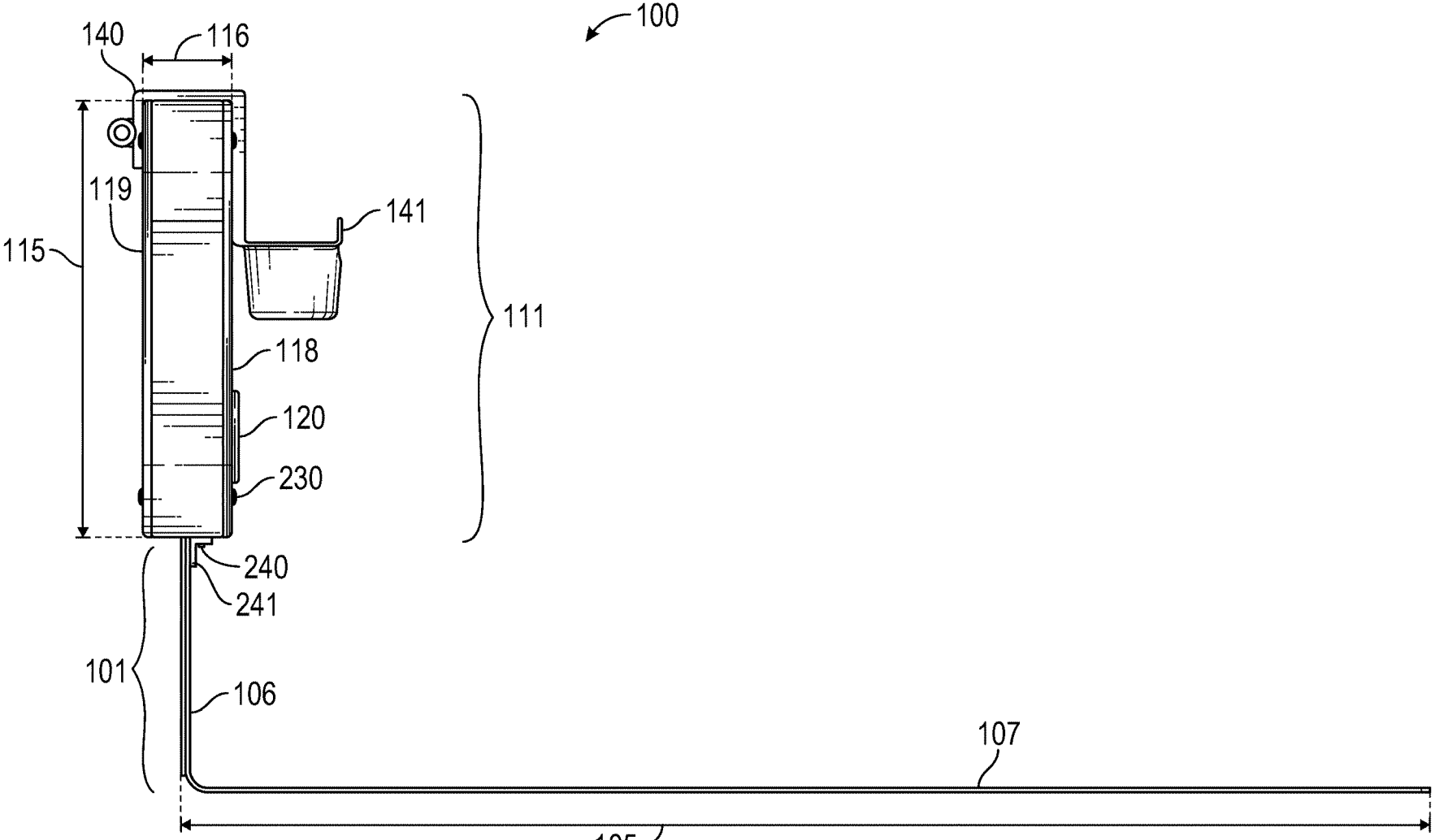
FIG. 1E may depict the assembled bed safety rail of FIG. 1A, but shown from a left-side view.
Figure 1F:
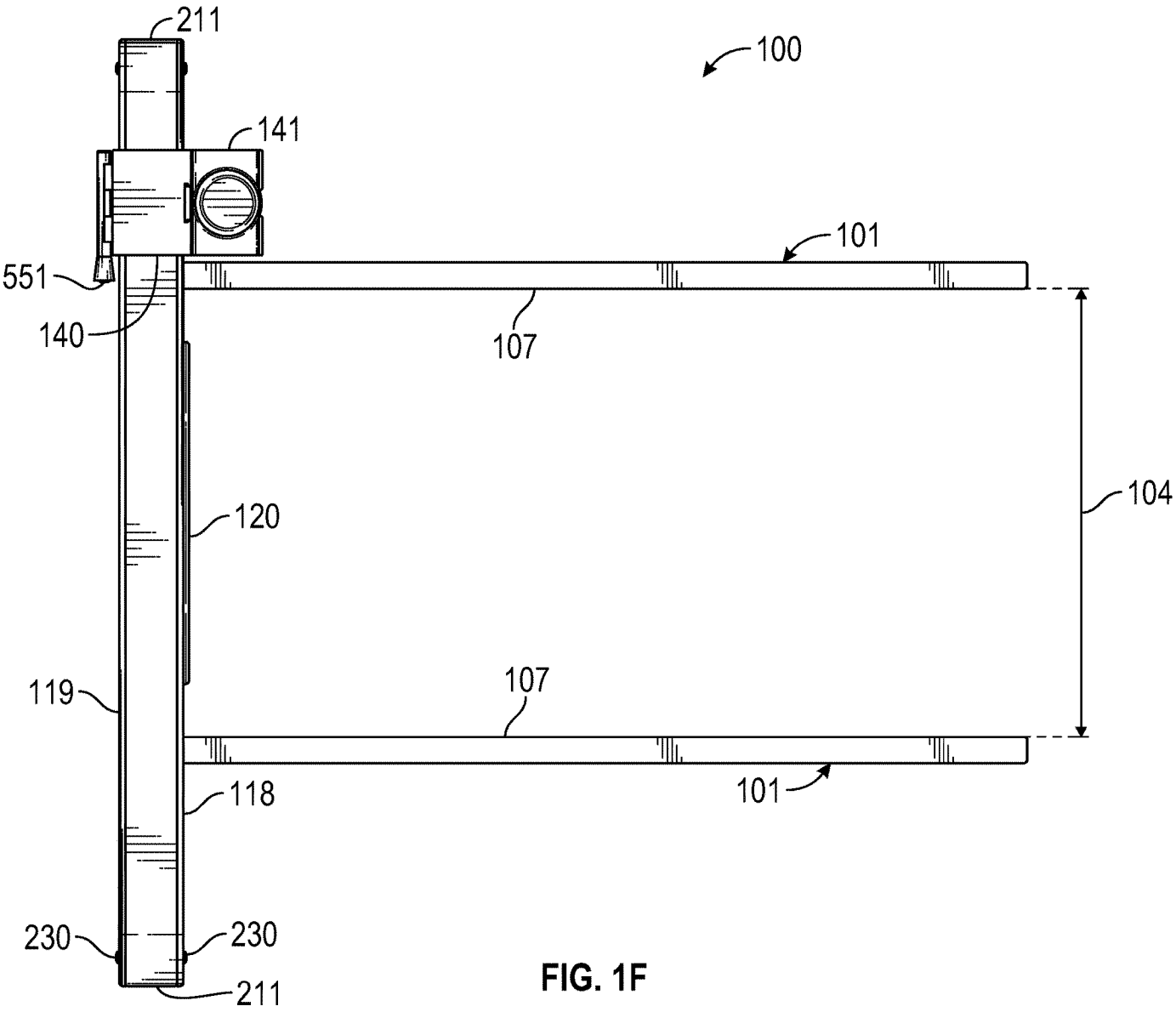
FIG. 1F may depict the assembled bed safety rail of FIG. 1A, but shown from a top view.
Figure 1G:
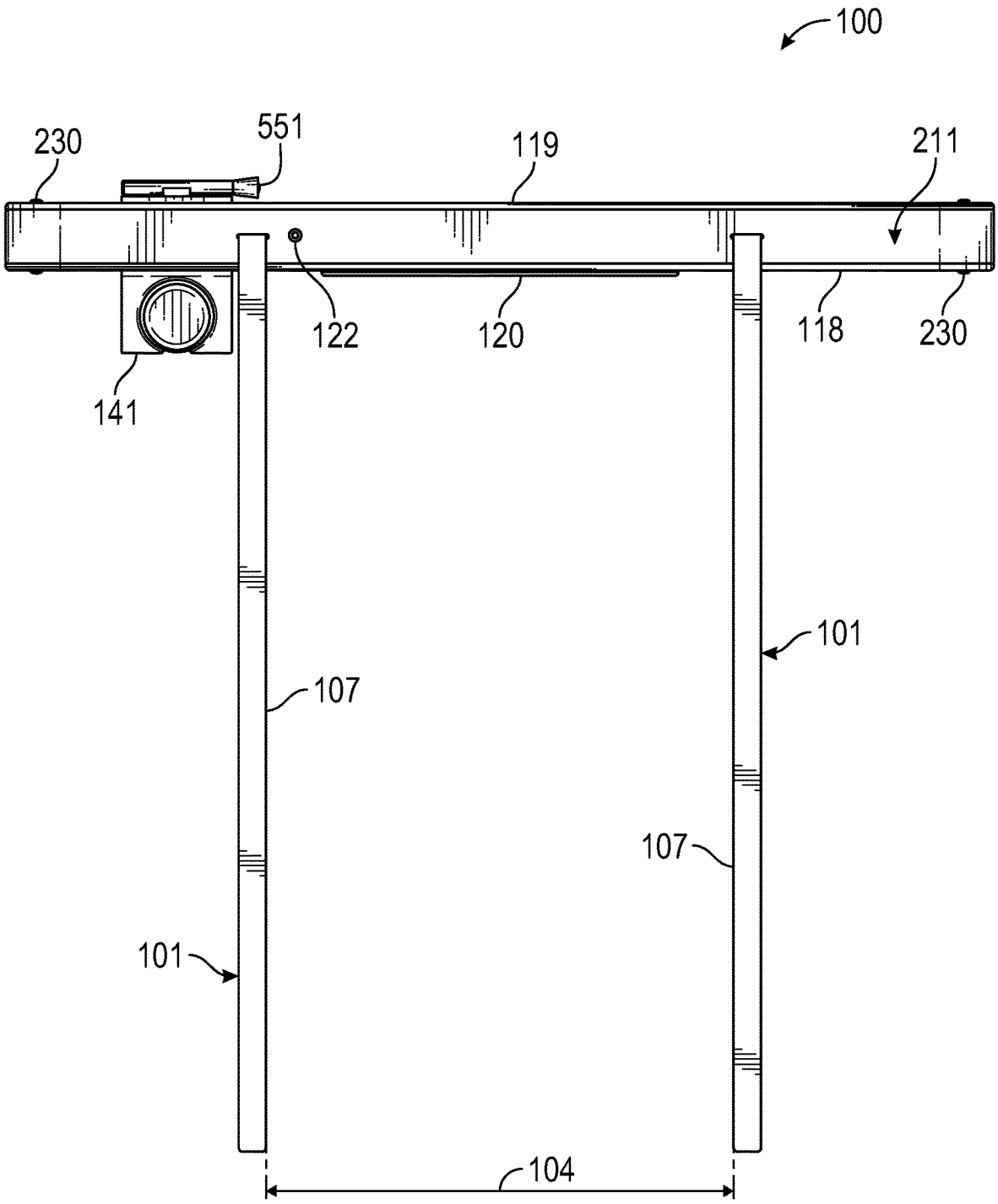
FIG. 1G may depict the assembled bed safety rail of FIG. 1A, but shown from a bottom view.
Figure 1H:
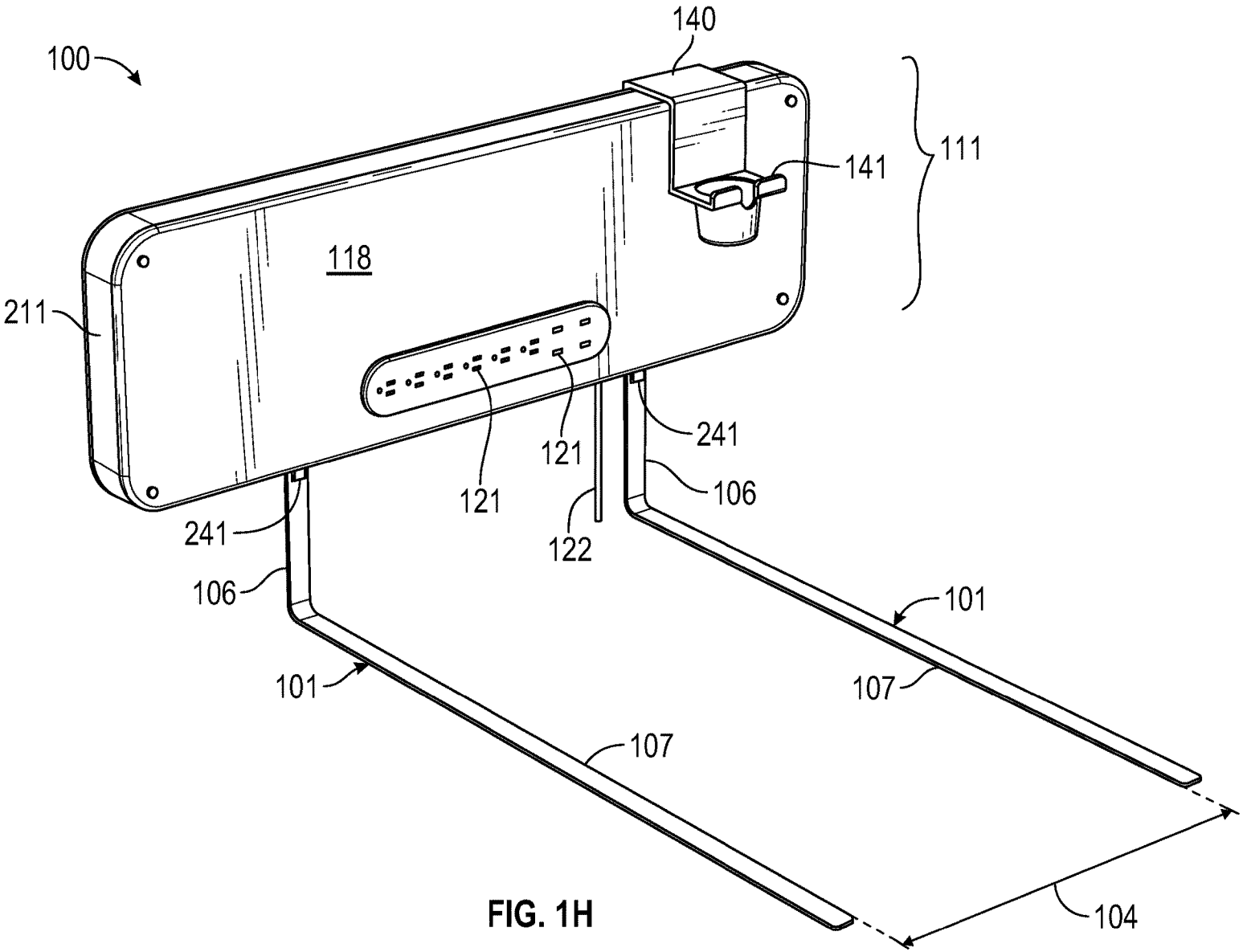
FIG. 1H may depict the assembled bed safety rail of FIG. 1A, shown from a top and front perspective view.

FIG. 1A may depict an overall assembled bed safety rail 100, shown from a top and rear perspective view. FIG. 1B may depict the assembled bed safety rail 100 of FIG. 1A, but shown from a rear (back) view. FIG. 1C may depict the assembled bed safety rail 100 of FIG. 1A, but shown from a front view. FIG. 1D may depict the assembled bed safety rail 100 of FIG. 1A, but shown from a right-side view. FIG. 1E may depict the assembled bed safety rail 100 of FIG. 1A, but shown from a left-side view. FIG. IF may depict the assembled bed safety rail 100 of FIG. 1A, but shown from a top view. FIG. 1G may depict the assembled bed safety rail 100 of FIG. 1A, but shown from a bottom view. FIG. 1H may depict the assembled bed safety rail 100 of FIG. 1A, shown from a top and front perspective view.

In some embodiments, bed safety rail 100 may comprises at least one horizontal-anchor-member 101 and at least one vertical-safety-rail-member 111. In some embodiments, when bed safety rail 100 may be in proper use (e.g., with at least one horizontal-anchor-member 101 removably anchored between a mattress and a bedframe of a bed); at least one vertical-safety-rail-member 111 may be a physical obstruction minimizing a user from falling off of the bed. In some embodiments, at least portions of at least one vertical-safety-rail-member 111 may function as a safety rail. See e.g., FIG. 1A and FIG. 1H. (See provisional patent application 62/367,398 filed on Jul. 27, 2016, the disclosure of which is incorporated herein by reference in its entirety, for bed 900, bed-frame 901, and/or mattress 911.)

In some embodiments, at least one horizontal-anchor-member 101 may be for removably anchoring bed safety rail 100 to a bed. In some embodiments, at least one horizontal-anchor-member 101 may comprise a vertical-portion 106 and a horizontal-portion 107; wherein vertical-portion 106 may transition into horizontal-portion 107. See e.g., FIG. 1A, FIG. 1F, FIG. 1G, FIG. 1H, and FIG. 2.

In some embodiments, a portion of vertical-portion 106 may extend up into a portion of vertical-frame-member 211 when bed safety rail may be in its assembled configuration. A bottom of vertical-frame-member 211 may have receiving-slots 806 for this purpose and seat-fastener-receiving-holes 842 adjacent to such receiving-slots 806 for receiving seat-fasteners 240. See e.g., FIG. 8. In some embodiments, vertical-portion 106 that extends beyond and out of a bottom of vertical-frame-member 211 up to horizontal-portion 107 may be about seven inches in dimension, plus or minus one inch. In other embodiments, this dimension may be a different predetermined dimension.

In some embodiments, at least one horizontal-anchor-member 101 may comprise at least two separate horizontal-anchor-members 101, wherein the at least two separate horizontal-anchor-members 101 may be fixedly spaced from each other by a predetermined spacing 104. See e.g., FIG. 1A, FIG. 1F, FIG. 1G, FIG. 1H, and FIG. 2. For example, and without limiting the scope of the present invention, in some embodiments, predetermined spacing 104 may be about 17 inches, plus or minus one inch. In other embodiments, predetermined spacing 104 may be another predetermined dimension.

In some embodiments, horizontal-portion 107 of at least one horizontal-anchor-member 101 may be of a predetermined length 105. See e.g., FIG. 1D and FIG. 1E. In some embodiments, predetermined length 105 may be fixed; i.e., non-variable. For example, and without limiting the scope of the present invention, in some embodiments, predetermined length 105 may be about 34 inches, plus or minus two inches. In other embodiments, predetermined length 105 may be another predetermined dimension.

In some embodiments, at least one horizontal-anchor-member 101 may be one or more of: an L-shaped member; substantially rigid, a structural member, and/or an elongate planar member. In some embodiments, horizontal-portions 107 of at least one horizontal-anchor-member 101 may be substantially covered by a mattress; i.e., horizontal-portions 107 may be sandwiched between the mattress and the bed-frame of the bed; wherein the weight of the mattress alone may be sufficient to anchor bed safety rail 100 to the bed, because the predetermined length 105 may be of sufficient length (e.g., at least 34 inches in some embodiments) and at least one horizontal-anchor-member 101 may be substantially rigid. See e.g., FIG. 1A, FIG. 1B, FIG. 1C, FIG. 1D, FIG. 1E, FIG. 1F, FIG. 1G, FIG. 1H, and FIG. 2.

In some embodiments, at least one vertical-safety-rail-member 111 may be substantially vertical with respect to horizontal-portion 107 of at least one horizontal-anchor-member 101. See e.g., FIG. 1A, FIG. 1D, FIG. 1E, and FIG. 1H. In some embodiments, at least one vertical-safety-rail-member 111 may be attached to at least one horizontal-anchor-member 101. See e.g., FIG. 1G.

In some embodiments, at least one vertical-safety-rail-member 111 may be a subassembly; wherein this subassembly may comprise a front-panel 118, a rear-panel 119, and a vertical-frame-member 211 disposed between these two panels. See e.g., FIG. 1A, FIG. 1H, and/or FIG. 2.

In some embodiments, at least one vertical-safety-rail-member 111 may comprise front-panel 118 and disposed opposite rear-panel 119. In some embodiments, a major surface of front-panel 118 may be substantially parallel to a major surface of rear-panel 119. See e.g., FIG. 1D, FIG. 1E and/or FIG. 2.

In some embodiments, front-panel 118, rear-panel 119, or both front-panel 118 and rear-panel 119 may comprise sufficient ferrous metal to receive removable attachment of a magnet 961. In some embodiments, such panels (i.e., front-panel 118 and/or rear-panel 119) may be magnet boards. See e.g., FIG. 1A.

In some embodiments, front-panel 118, rear-panel 119, or both front-panel 118 and rear-panel 119 may be one or more of: substantially flat; substantially planar; substantially smooth; substantially glossy, substantially of a light color as a white, off white, or the like color; and/or substantially non-porous functioning as a dry erase board. In some embodiments, exterior surfaces (major surfaces) of front-panel 118 and/or rear-panel 119 may be dry erase boards (or also known as markerboard). In some embodiments, front-panel 118 and/or rear-panel 119 may be substantially constructed from shower board that may be substantially flat, planar, smooth, and non-porous. In some embodiments, front-panel 118 and/or rear-panel 119 may be substantially constructed from melamine or melamine like board; wherein a melamine board may be a resin-infused paper over a substrate that may be selected from particle board to MDF (medium density fiberboard). See e.g., FIG. 1A, FIG. 1B, FIG. 1C, FIG. 1D, FIG. 1E, FIG. 1F, FIG. 1G, FIG. 1H, and FIG. 2.

In some embodiments, front-panel 118 and/or rear-panel 119 may present a substantially continuous surface (e.g., the major surface of each such panel) to the user; rather than presenting a frame-work member or lattice member to the user. See e.g., FIG. 1A, FIG. 1B, FIG. 1C, FIG. 1D, FIG. 1E, FIG. 1F, FIG. 1G, FIG. 1H, and FIG. 2. Providing such a continuous surface to the user may provide for better safety, and/or an increased feeling of security for the user. In some embodiments, the continuous surface may also be used as the dry erase board and/or as the magnet board.

In some embodiments, front-panel 118 and rear-panel 119 may be cut, die cut, and/or stamped from a sheet of plastic or from a roll of plastic.

In some embodiments, front-panel 118 and rear-panel 119 may be fixedly and oppositely disposed from each other by a predetermined thickness 116. See e.g., FIG. 1D and FIG. 1E. In some embodiments, this predetermined thickness 116 may be about 2.5 inches, plus or minus 0.25 of an inch. In other embodiments, predetermined thickness 116 may be other predetermined dimensions.

In some embodiments, bed safety rail 100 may comprise at least one clip 140. In some embodiments, predetermined thickness 116 may be sized to slidingly and removably receive at least one clip 140, at a top of the at least one vertical-safety-rail-member 111. In some embodiments, at least one clip 140 may removably receive a clip-accessory 141. See e.g., FIG. 1A, FIG. 1B, FIG. 1C, FIG. 1D, FIG. 1E, FIG. 1F, FIG. 1G, FIG. 1H, and FIG. 2.

In some embodiments, at least one clip 140 may slide along a top of at least one vertical-safety-rail-member 111. Thus, at least one clip 140 with its removably attached clip-accessory 141, may be positioned anywhere along width 114 of vertical-safety-rail-member 111 for the convenience of the give user.

In some embodiments, clip-accessory 141 may be selected from one or more of: a writing-implement-holder; a cup-holder (see e.g., FIG. 1A, FIG. 1B, FIG. 1C, FIG. 1D, FIG. 1E, FIG. 1F, FIG. 1G, FIG. 1H, FIG. 2, FIG. 5A, FIG. 5B, FIG. 5C, FIG. 5D, and FIG. 5E); a shelf 641 (see e.g., FIG. 6A); a light-source 642 (see e.g., FIG. 6B); and/or the like. In some embodiments, the cup-holder may hold a cup or may hold on or more writing-implements 551. In some embodiments, the cup-holder of a given clip-accessory 141 may be a writing-implement-holder, in that the cup-holder portion may removably receive one or more writing-implements 551.

In some embodiments, at least one clip 140 may comprise a writing-implement-holder 550 for removable receiving of at least one writing-implement 551. See e.g., FIG. 1A, FIG. 1B, FIG. 1D, FIG. 1E, FIG. 1F, FIG. 1G, FIG. 5A, and FIG. 5B. In some embodiments, writing-implement-holder 550 of clip 140, may be located on clip 140, such that writing-implement-holder 550 is closer to rear-panel 119 than to front-panel 118, as this may minimize a sleeping user from bumping into writing-implement-holder 550 and/or into writing-implement 551 and dislodging it from writing-implement-holder 550. See e.g., FIG. 1A, FIG. 1B, FIG. 1D, FIG. 1E, FIG. 1F, FIG. 1G, FIG. 5A, and FIG. 5B.

In some embodiments, at least one vertical-safety-rail-member 111 may have a predetermined width 114 (see e.g., FIG. 1B and FIG. 1C) and may have a predetermined height 115 (see e.g., FIG. 1D and FIG. 1E). In some embodiments, predetermined width 114 and predetermined height 115 may be substantially orthogonal with respect to each other. In some embodiments, predetermined spacing 104 may be greater than predetermined height 115. In some embodiments, predetermined spacing 104 may be less than predetermined width 114.

For example, and without limiting the scope of the present invention, in some embodiments, predetermined width 114 may be about 36 inches, plus or minus two inches. In other embodiments, predetermined width 114 may other predetermined dimensions.

For example, and without limiting the scope of the present invention, in some embodiments, predetermined height 115 may be about 12 inches, plus or minus one inch. In other embodiments, predetermined height 115 may other predetermined dimensions.

In some embodiments, length 105 may be a greater dimension than height 115. In some embodiments, horizontal-portion 107 of at least one horizontal-anchor-member 101 may have predetermined length 105; wherein a ratio of predetermined length 105 to predetermined height 115 may be from 2.5 to 3.0. In other embodiments, this ratio may be another predetermined range.

In some embodiments, width 114 may be a greater dimension than spacing 104. In some embodiments, a ratio of predetermined width 114 to predetermined spacing 104 may be from 2.0 to 2.5. In other embodiments, this ratio may be another predetermined range.

Figure 2:
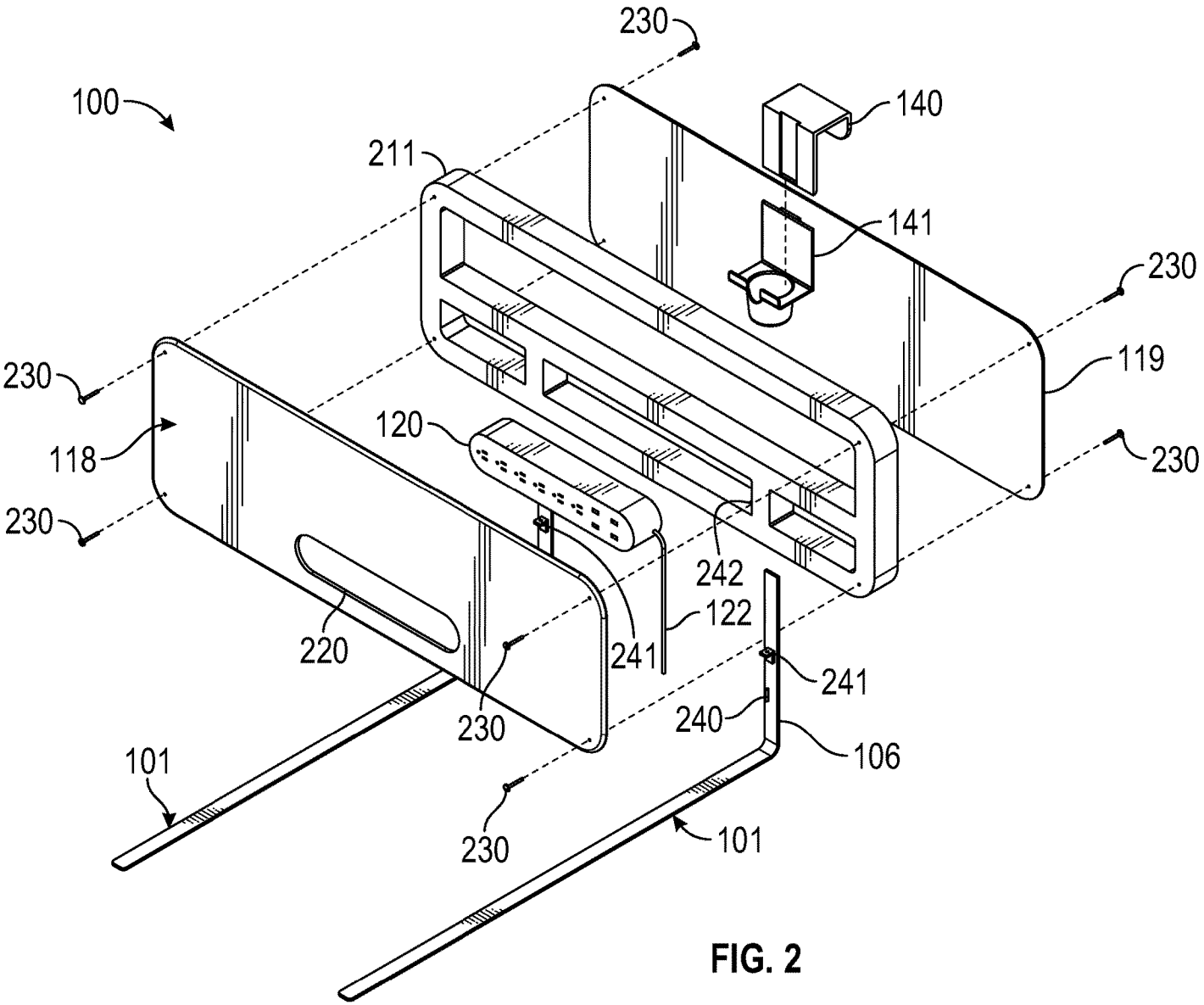
FIG. 2 may depict an exploded perspective view of the bed safety rail shown in FIG. 1A.

FIG. 2 may depict an exploded perspective view of bed safety rail 100 shown in FIG. 1A. In some embodiments, at least one vertical-safety-rail-member 111 may be a subassembly; wherein this subassembly may comprise front-panel 118, rear-panel 119, and vertical-frame-member 211 disposed between these two panels. See e.g., FIG. 2, FIG. 1A, and/or FIG. 1H.

In some embodiments, at least one vertical-safety-rail-member 111 may comprise vertical-frame-member 211 that may be a structural member and that may be substantially rigid. In some embodiments, vertical-frame-member 211 may provide structural rigidity to at least one vertical-safety-rail-member 111. In some embodiments, vertical-frame-member 211 may provide a structural anchor location for attachment of vertical-portion 106 of horizontal-anchor-member 101 to the at least one vertical-safety-rail-member 111. See e.g., FIG. 2.

In some embodiments, vertical-frame-member 211 may be substantially constructed from tubular members. In some embodiments, vertical-frame-member 211 may be substantially constructed of a metal (such as, but not limited to, aluminum) and/or of a thermos formed plastic. In some embodiments, front-panel 118, rear-panel 119, electronics-module 120, and/or brackets 241 may be attached to and/or mounted to vertical-frame-member 211. In some embodiments, such mounting and/or attachment may be accomplished by fasteners 230, seat-fasteners 240, other mechanical fasteners, adhesives, welds, and/or the like. In some embodiments, fasteners 230 and/or seat-fasteners 240 may be threaded screws or bolts. In some embodiments, a given bracket 241 may be attached to a portion of vertical-portion 106. In some embodiments, a given seat-fastener 240 may be used to attached a given bracket 241 to vertical-frame-member 211 at a seat-fastener-receiving-hole 842, that may be located on a bottom of 211, see e.g., FIG. 8.

In some embodiments, bed safety rail 100 may comprise at least one electronics-module 120. See e.g., FIG. 2, FIG. 1C, FIG. 1D, FIG. 1E, FIG. 1F, FIG. 1G, and FIG. 1H. In some embodiments, at least one electronics-module 120 may comprise a power-cord 122 and may comprise one or more connectors 121 as plug receivers. In some embodiment, power-cord 122 may provide electrical power to one or more connectors 121. In some embodiments, one or more connectors 121 may be female connectors for removable receiving one or more of: electrical-power-plugs (such as a standard electrical plug); USB-plugs (wherein "USB" may refer to "universal serial bus); or plugs for receiving at least some of the electrical power. In some embodiments, at least one electronics-module 120 may be a surge protector and/or an outlet strip. In some embodiments, a portion of power-cord 122 may extend through power-cord-hole 242; wherein power-cord-hole 242 may be located in and through a portion of vertical-frame-member 211, see e.g., FIG. 2.

In some embodiments, at least one electronics-module 120 may provide the user with a bank of connectors 121, such that the user may plug a variety and a predetermined quantity of electronic devices into such connectors 121, either for battery charging and/or for electrical power for operation of the given electrical device. This may permit the user, while in bed, to use and/or charge various electronic devices, such as, but not limited, to smartphones, tablet computing devices and/or the like. While the given electronic device may be receiving some electrical power, that given electronic device may removably rest upon some portion of clip-accessory 141, such as, but not limited to, upon or in the cup-holder or on shelf 641.

In some embodiments, at least one vertical-safety-rail-member 111 may comprise at least one panel (e.g., front-panel 118 and/or rear-panel 119). In some embodiments, this at least one panel may comprise at least one electronics-module-cutout 220, which may be a cutout in the at least one panel for receiving the at least one electronics-module 120. See e.g., FIG. 2.

In some embodiments, at least one electronics-module-cutout 220 may be a closed two dimensional (2D) shape. In some embodiments, at least one electronics-module-cutout 220 may be substantially rectangular in shape, with or without rounded corners, or with or without half-circles at its terminal ends. In some embodiments, at least one electronics-module-cutout 220 may be located in a bottom one third of the given panel (e.g., 118 or 119). See e.g., FIG. 2.

In some embodiments, at least one vertical-safety-rail-member 111 may comprise front-panel 118 and disposed opposite rear-panel 119; wherein the at least one electronics-module 120 may be substantially disposed between front-panel 118 and rear-panel 119; but not including power-cord 122 which may extend beyond such panels (e.g., 118 and/or 119); and not including a front face portion of at least one electronics-module 120 which may extend beyond one of the panels (e.g., 118 and/or 119). See e.g., FIG. 2, FIG. 1C, FIG. 1D, FIG. 1E, FIG. 1F, FIG. 1G, and FIG. 1H.

In some embodiments, at least one vertical-safety-rail-member 111 may comprise vertical-frame-member 211 that may be a structural member and that may be substantially rigid; wherein at least electronics-module 120 may be substantially disposed within vertical-frame-member 211; but not including power-cord 122 which may extend beyond vertical-frame-member 211; and not including a front face portion of at least one electronics-module 120 which may extend beyond vertical-frame-member 211. See e.g., FIG. 2, FIG. 1C, FIG. 1D, FIG. 1E, FIG. 1F, FIG. 1G, and FIG. 1H.

Figure 3:
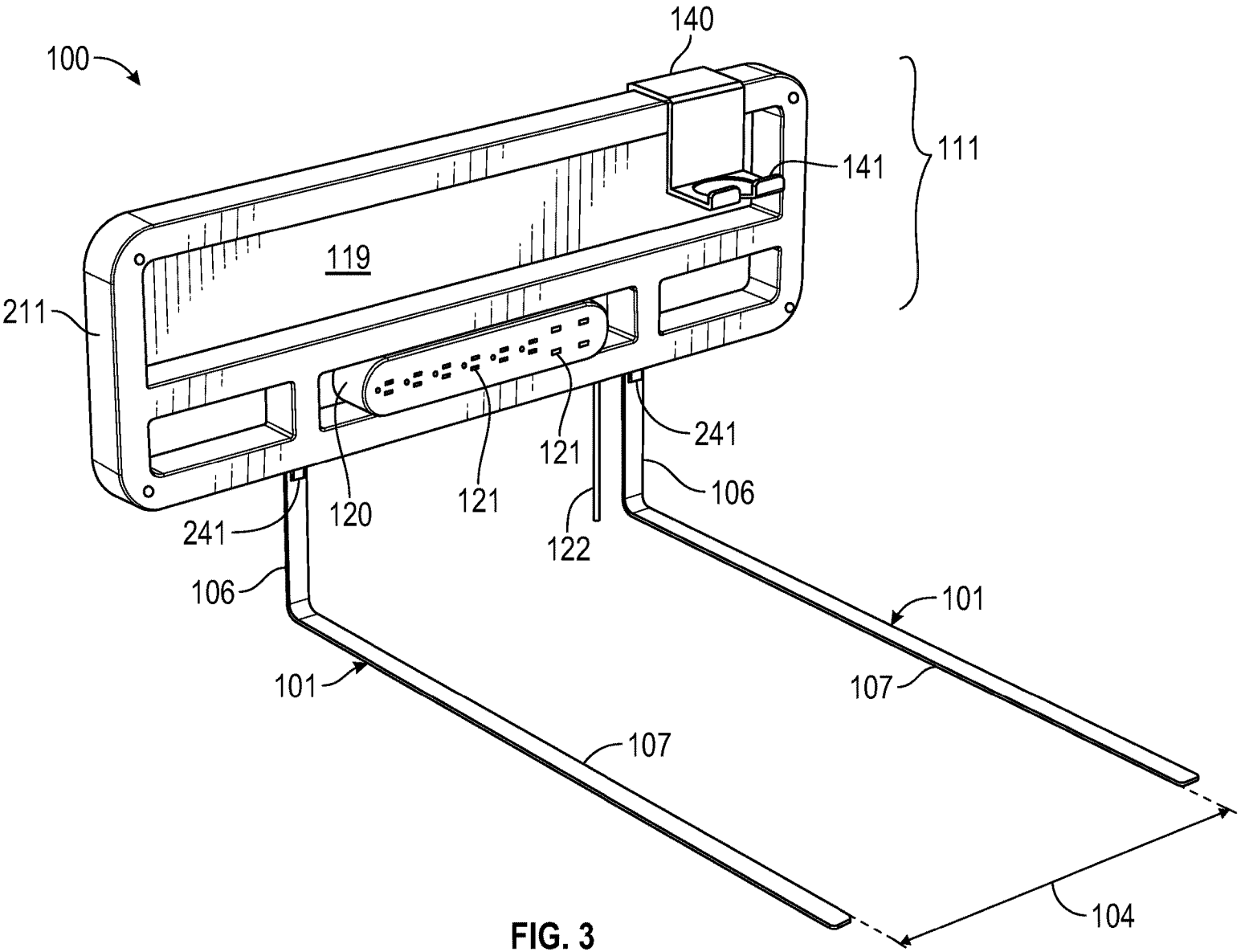
FIG. 3 may depict the bed safety rail of FIG. 1A, shown in a perspective view, with a front panel removed.

FIG. 3 may depict bed safety rail 100 of FIG. 1A, shown in a perspective view, with a front-panel 118 removed to show possible internal layout of bed safety rail 100. For example, and without limiting the scope of the present invention, more of at least one electronic s-module 120 may be seen in FIG. 3. In some embodiments, portions of at least one electronics-module 120 may be disposed within vertical-frame-member 211.

Figure 4:
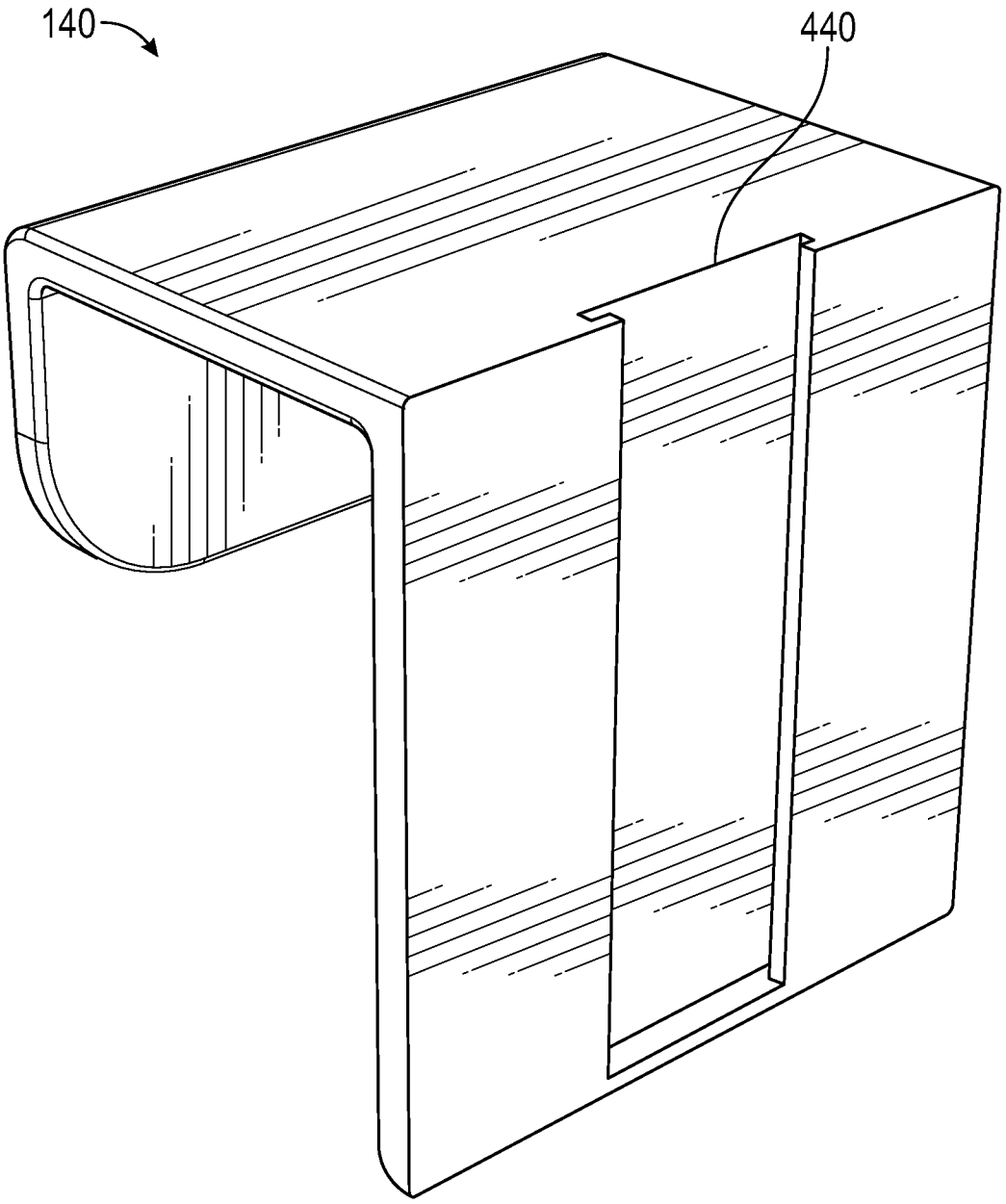
FIG. 4 may depict a perspective view of a clip (e.g., a universal clip) for removable attachment to the bed safety rail of FIG. 1A.

FIG. 4 may depict a perspective view of a clip 140 (e.g., a universal clip) for removable attachment to bed safety rail 100 of FIG. 1A. An inverted u-shape of joined substantially flat and planar members of clip 140 may be a portion of clip 140 that may removably and slidingly couple to the top of vertical-safety-rail-member 111. In some embodiments, clip 140 may comprise receiving-channel 440. See FIG. 4. In some embodiments, receiving-channel 440 may be sized and shaped to removably receive a wedge-for-receiving-channel 540 of a given clip-accessory 141. In some embodiments, clip 140 may be manufactured by injection molding and/or 3D printing. In some embodiments, clip 140 may be substantially constructed from one or more thermoplastics.

Figure 5A:
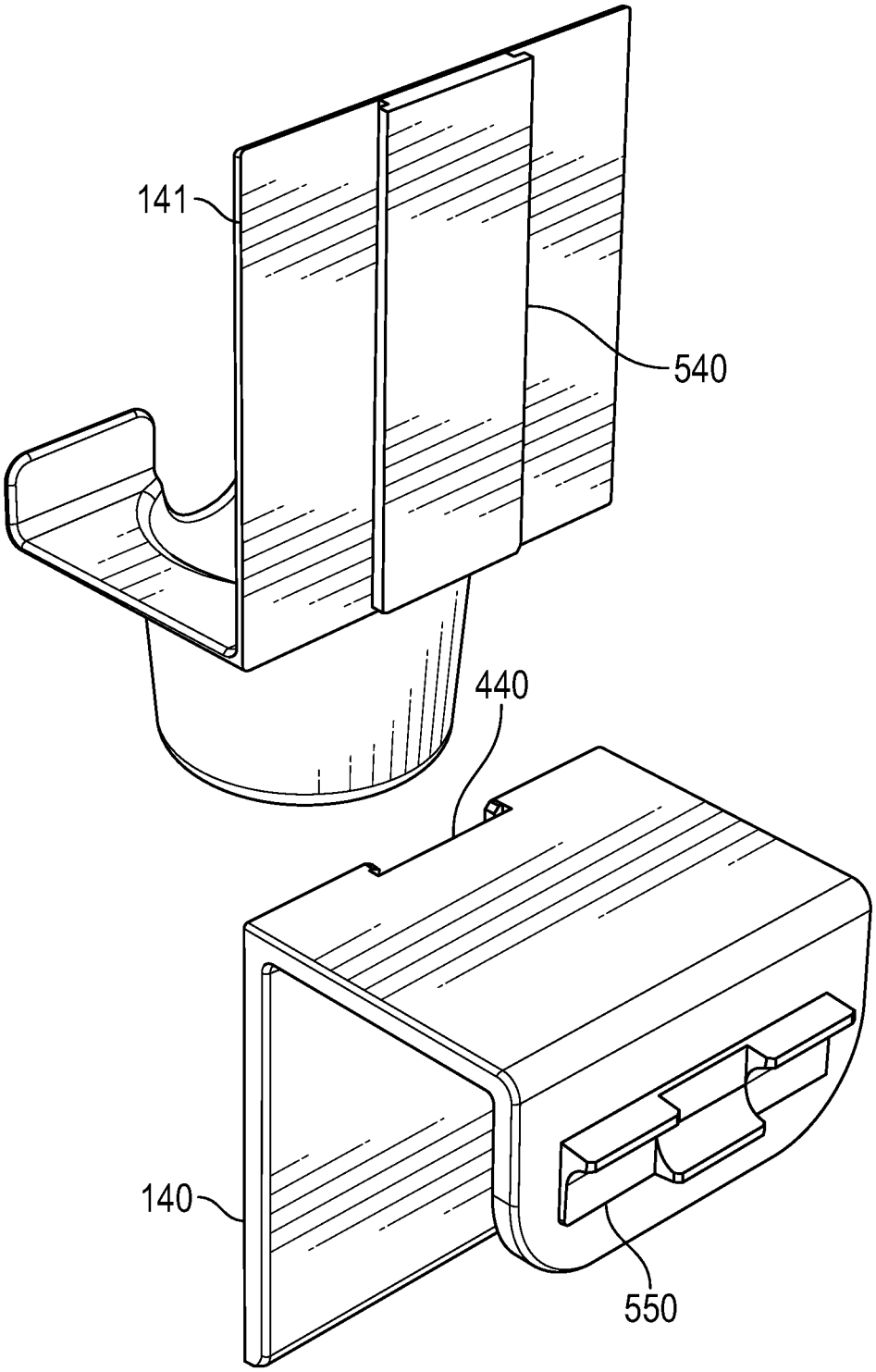
FIG. 5A may depict a perspective view of the clip of FIG. 4, exploded from a clip-accessory; wherein the clip-accessory, in some embodiments, may removably attach to the clip.
Figure 5B:
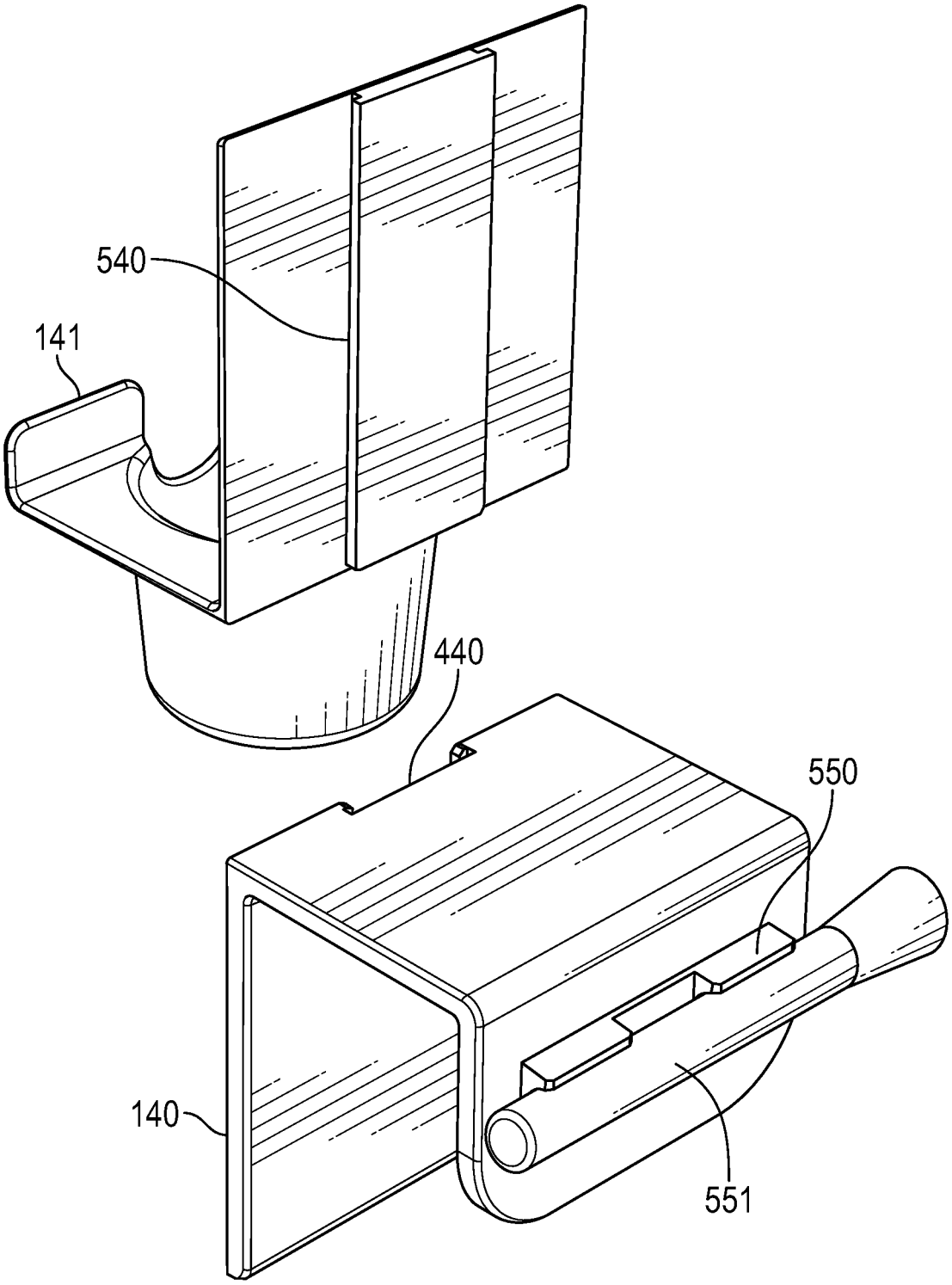
FIG. 5B may depict a perspective view of the clip of FIG. 4, exploded from a clip-accessory; wherein the clip-accessory may be removably holding a writing-implement.

FIG. 5A may depict a perspective view of clip 140, exploded from clip-accessory 141; wherein clip-accessory 141, in some embodiments, may removably attach to clip 140. FIG. 5B may depict the perspective view of clip 140, exploded from clip-accessory 141; wherein clip-accessory 141 may be removably holding writing-implement 551. Writing-implement 551 may not be shown in FIG. 5A. Both FIG. 5A and FIG. 5B, may show writing-implement-holder 550, which may be structure of clip 140. In some embodiments, writing-implement-holder 550 may be sized and shaped to removably hold at least one writing-implement 551.

Both FIG. 5A and FIG. 5B, may show wedge-for-receiving-channel 540 of clip-accessory 141. In some embodiments, clip-accessory 141 may comprise wedge-for-receiving-channel 540. In some embodiments, wedge-for-receiving-channel 540 may be sized and shaped to removably slide into receiving-channel 440 of clip 140; such that clip 140 may be removably coupled to clip-accessory 141. In some embodiments, wedge-for-receiving-channel 540 of clip-accessory 141 may be attached on a back of a substantially flat and planar member of clip-accessory 141. In some embodiments, this substantially flat and planar member portion of clip-accessory 141 may help to distribute loads of an accessory portion of clip-accessory 141 to one of the panels (e.g., 118 and/or 119). In some embodiments, the accessory portion of clip-accessory 141 may be located towards a bottom clip-accessory 141. In some embodiments, clip-accessory 141 may be substantially manufactured by injection molding and/or 3D printing. In some embodiments, clip-accessory 141 may be substantially constructed from one or more thermoplastics.

Figure 5C:
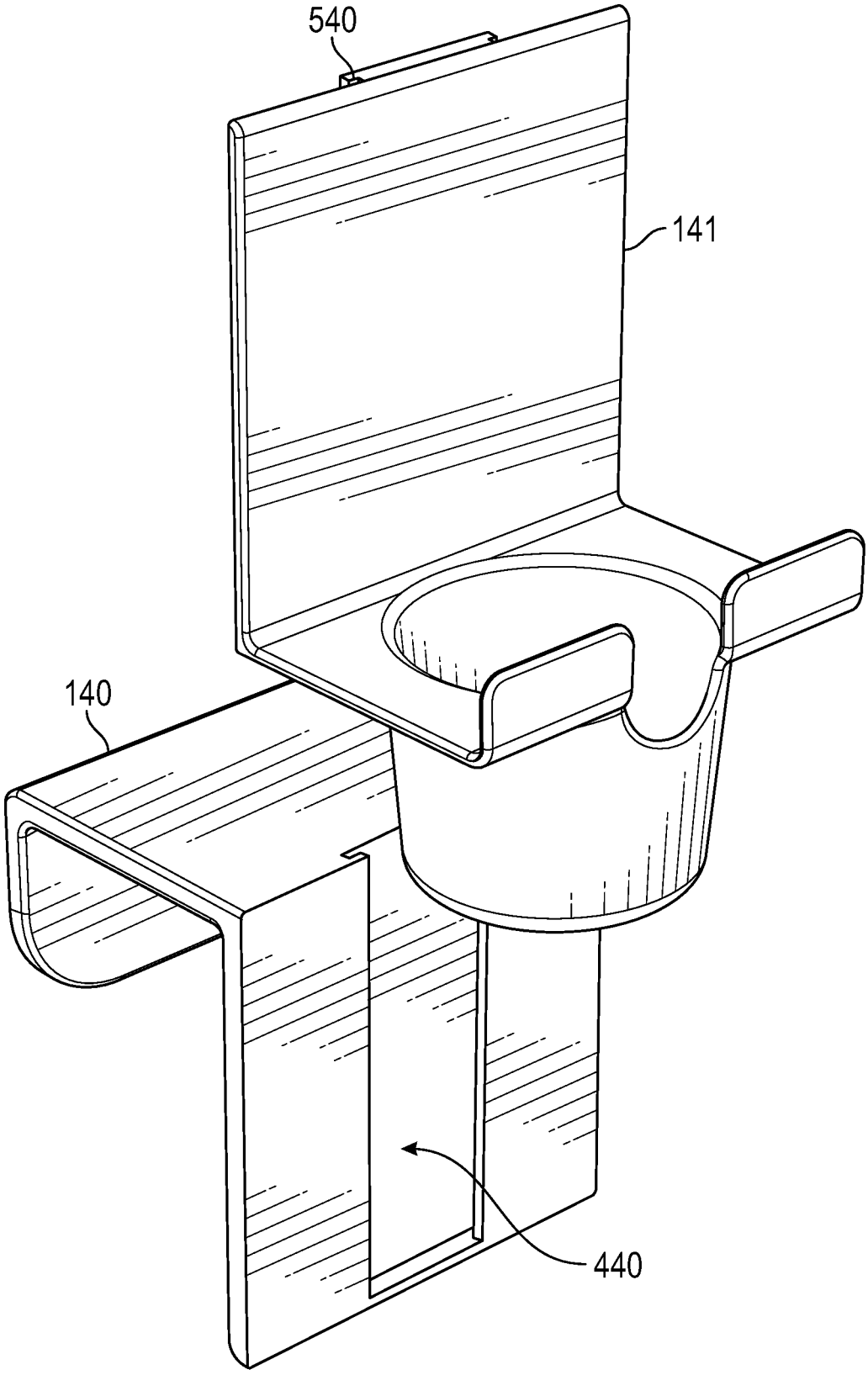
FIG. 5C may depict another perspective view of the clip of FIG. 4, exploded from the clip-accessory, as compared against FIG. 5A and FIG. 5B.

FIG. 5C may depict another perspective view of clip 140 exploded from clip-accessory 141, as compared against FIG. 5A and FIG. 5B.

Figure 5D:
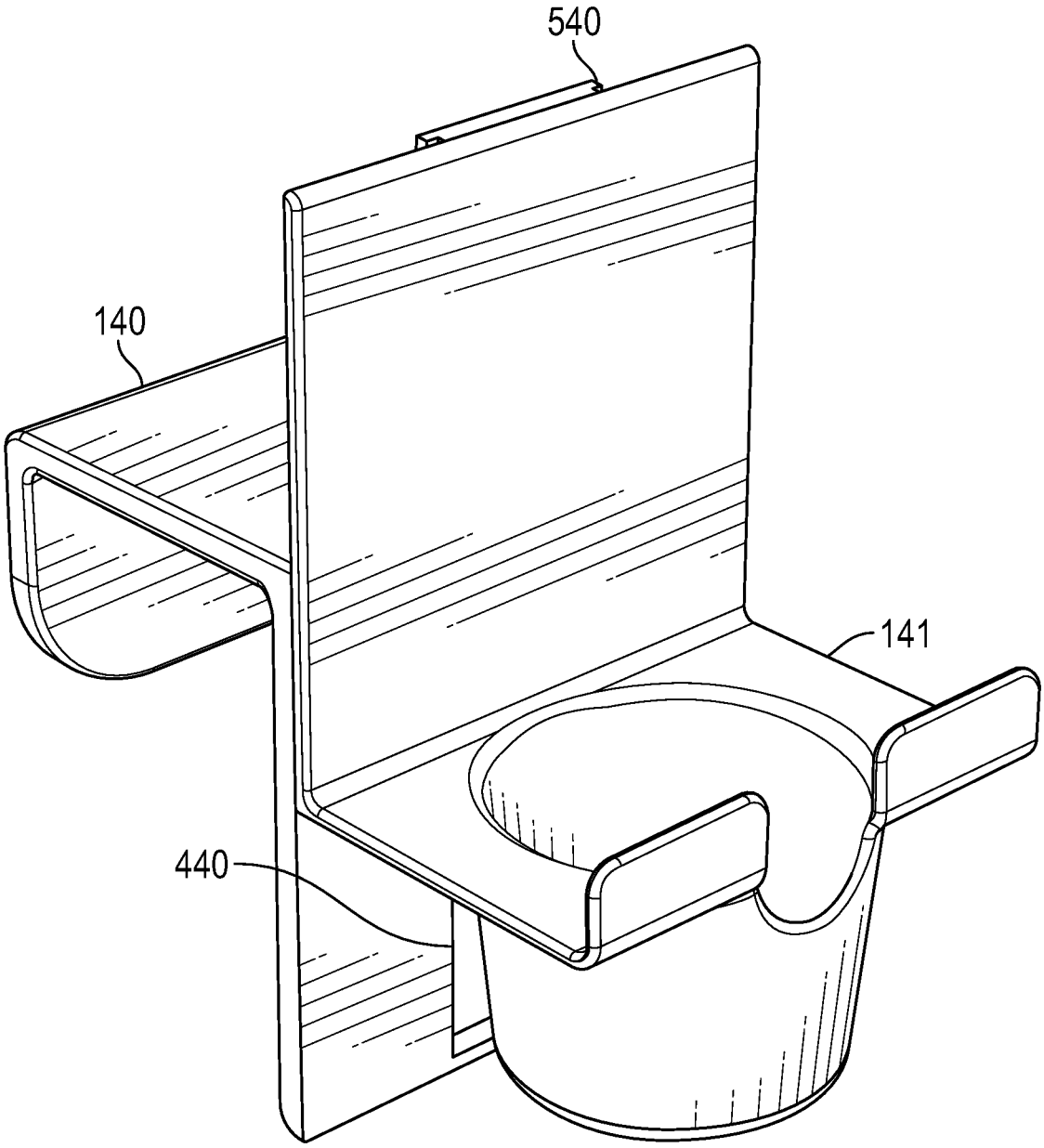
FIG. 5D may depict a perspective view of the clip of FIG. 4 and the clip-accessory, in a process of being removably coupled to each other, by a wedge-for-receiving-channel of the clip-accessory being removably slid down into a receiving-channel of the clip.

FIG. 5D may depict a perspective view of clip 140 and clip-accessory 141, in a process of being removably coupled to each other, by wedge-for-receiving-channel 540 being removably slid down into receiving-channel 440.

Figure 5E:
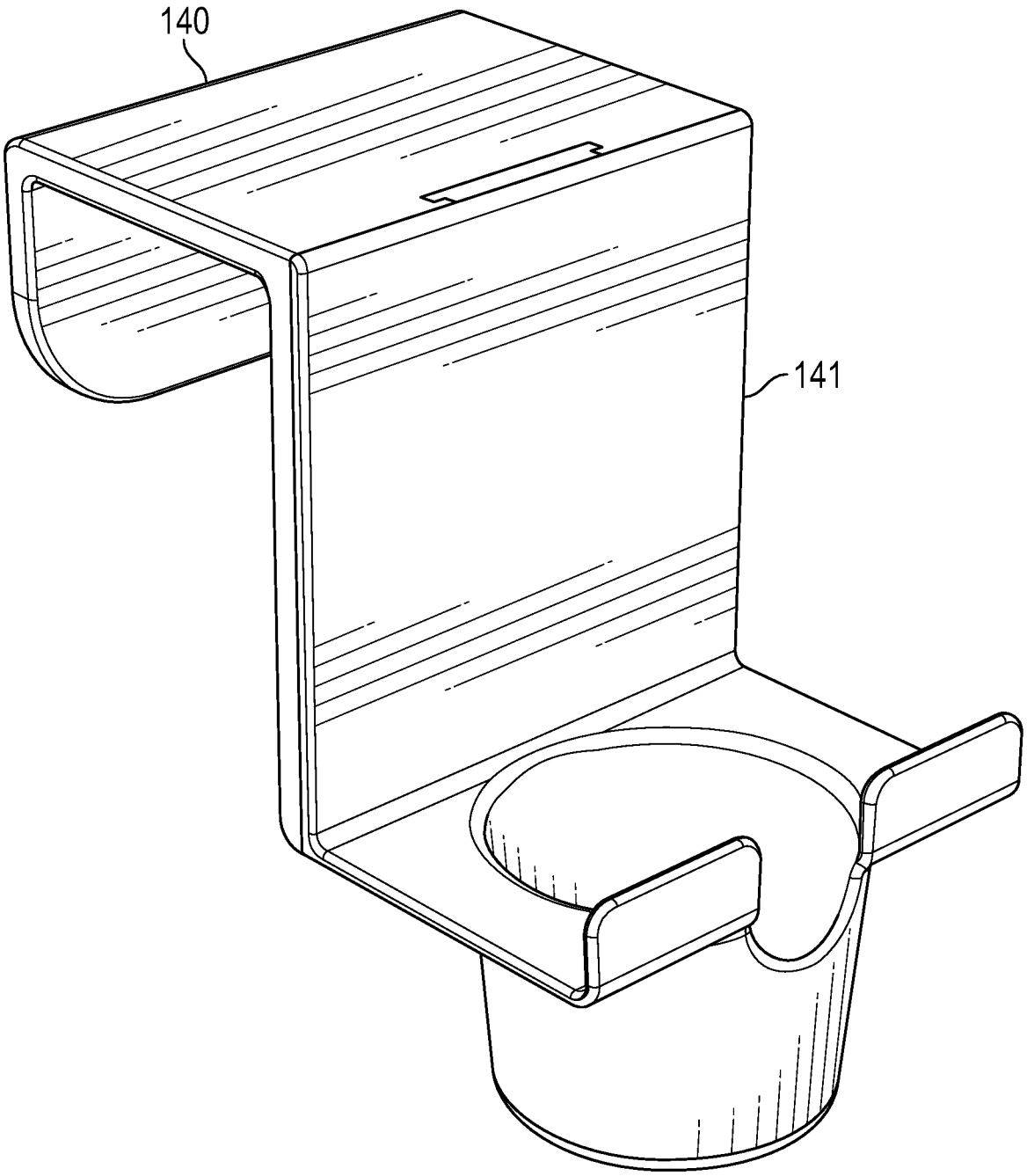
FIG. 5E may depict a perspective view of the clip of FIG. 4 and the clip-accessory completely and removably coupled to each other; for example, by the wedge-for-receiving-channel being completely and removably slid all the way down into the receiving-channel.

FIG. 5E may depict a perspective view of clip 140 and clip-accessory 141 completely removably coupled to each other; for example, by wedge-for-receiving-channel 540 being completely and removably slid all the way down into receiving-channel 440.

Figure 6A:
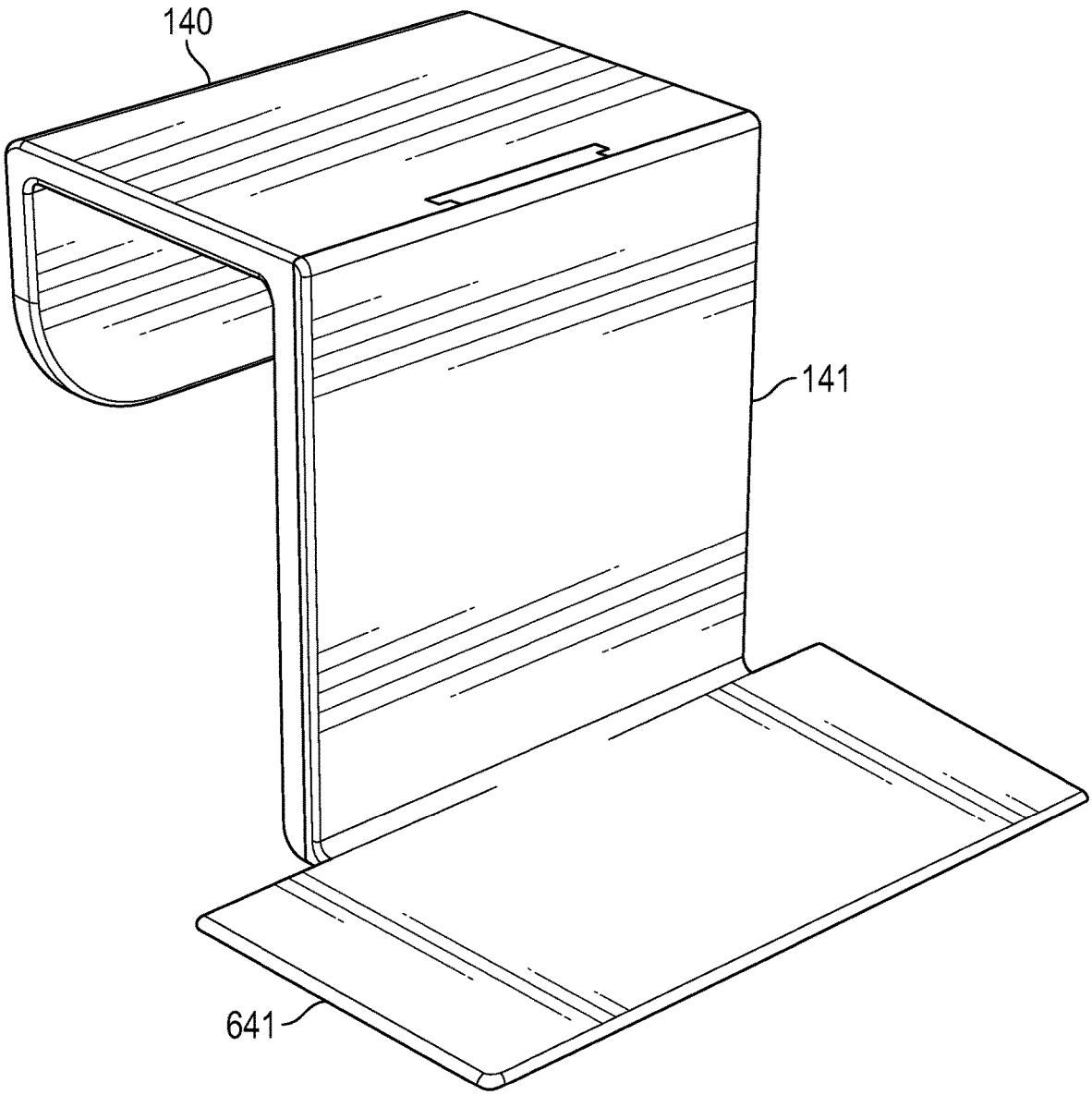
FIG. 6A may depict a clip-accessory removably coupled to the clip, wherein the clip-accessory may be shelf (e.g., a tray), shown from a perspective view.

FIG. 6A may depict clip-accessory 141 removably coupled to clip 140, wherein the clip-accessory 141 may comprise a shelf 641 (e.g., a tray) structure, shown from a perspective view. In some embodiments, clip-accessory 141 may not include a cup-holder structure; but rather, the cup-holder structure may be replaced with shelf 641. In some embodiments, such a shelf 641 may be used to removably support and/or store various articles, such as, but not limited to, books, magazines, notes, paper, glasses, clock, electronic devices, medication, and/or the like. Clip-accessory 141 shown in FIG. 6A may still comprise wedge-for-receiving-channel 540.

Figure 6B:
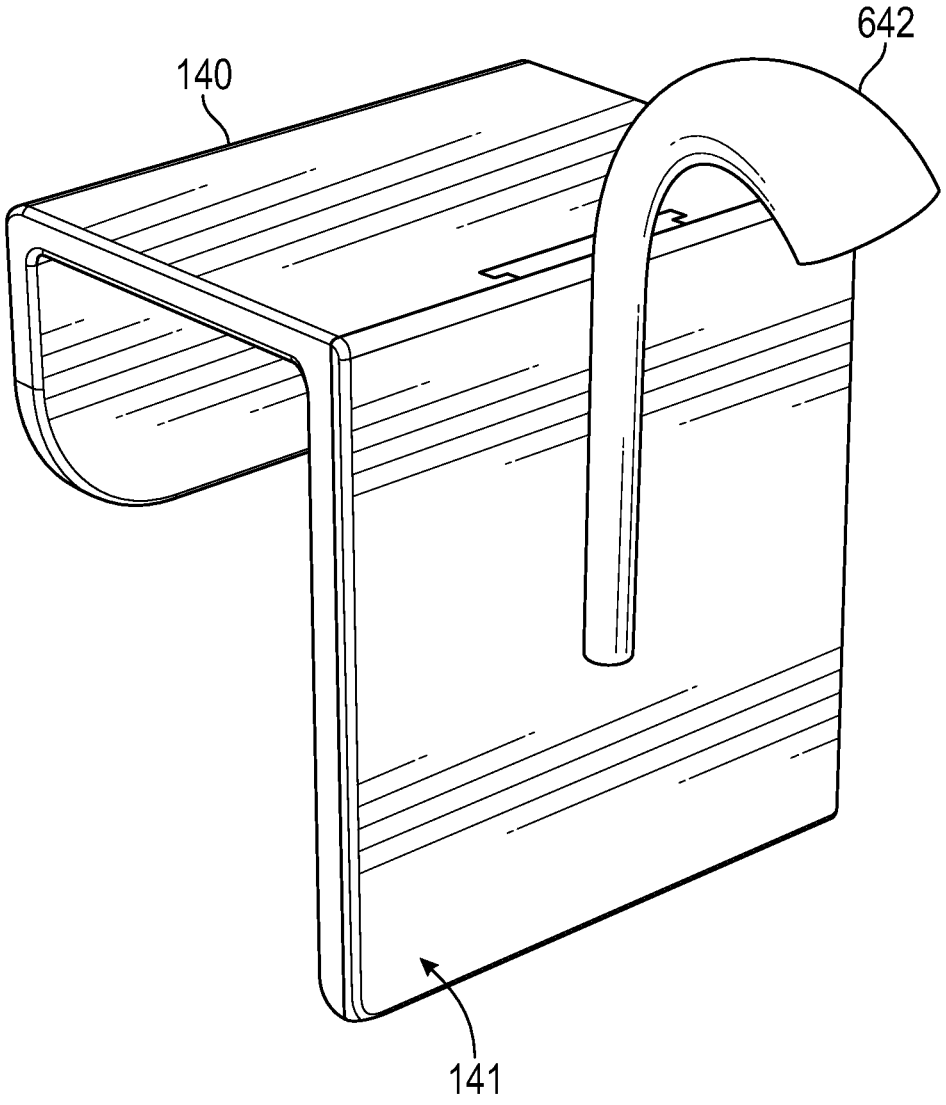
FIG. 6B may depict a clip-accessory removably coupled to the clip, wherein the clip-accessory may be a light-source, shown from a perspective view.

FIG. 6B may depict clip-accessory 141 removably coupled to clip 140, wherein the clip-accessory 141 may comprise a light-source 642, shown from a perspective view. In some embodiments, clip-accessory 141 may not include a cup-holder structure; but rather, the cup-holder structure may be replaced with light-source 642. In some embodiments, light-source 642 may be a lamp. In some embodiments, light-source 642 may be a reading light. In some embodiments, light-source 642 may be a nightlight. In some embodiments, light-source 642 may receive electrical power from at least one electronics-module 120. In some embodiments, light-source 642 may comprise a power cord (not shown in the drawings) that may be removably plugged into a connector 121 of at least one electronics-module 120. Clip-accessory 141 shown in FIG. 6B may still comprise wedge-for-receiving-channel 540.

Figure 7:
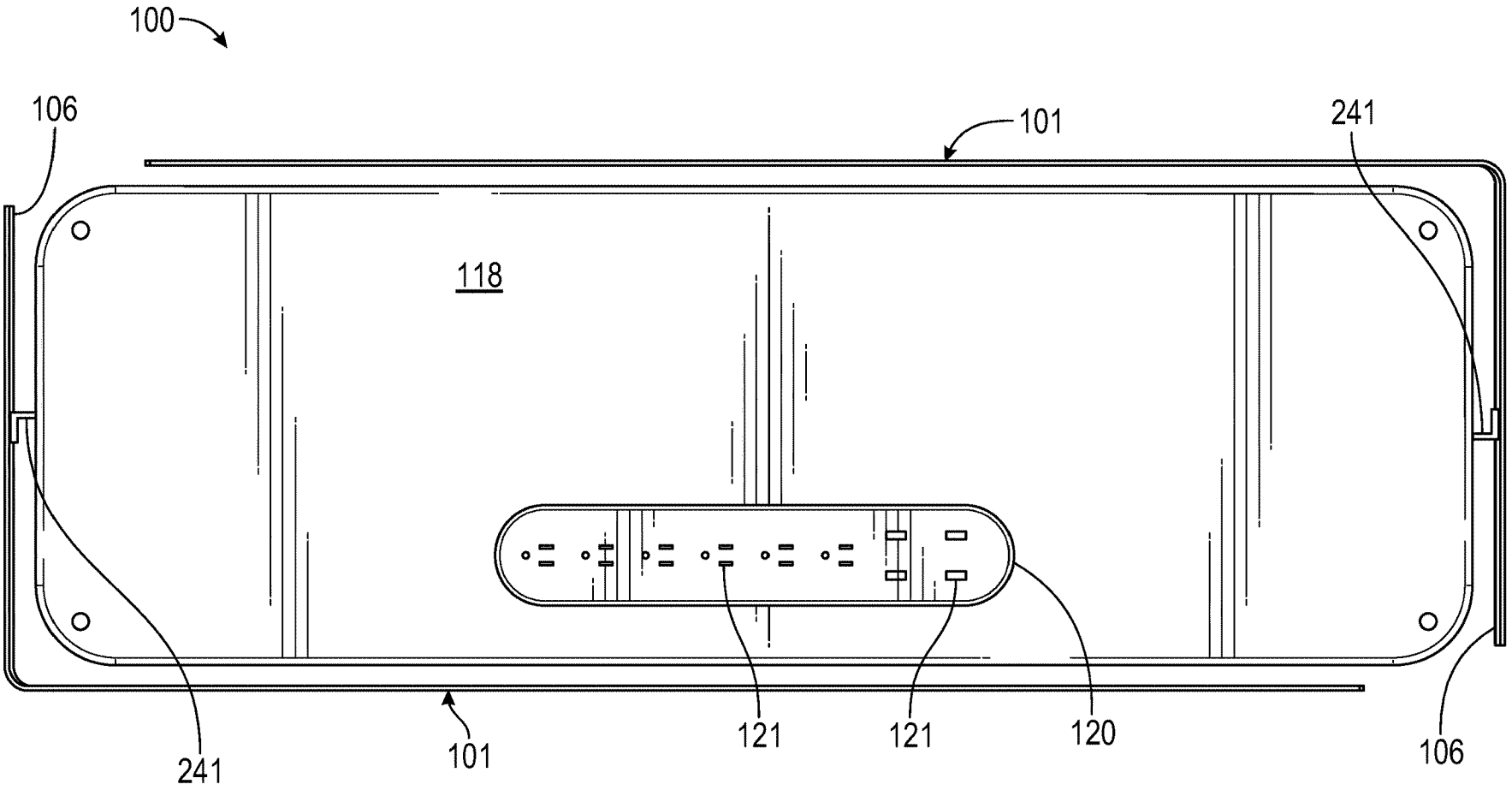
FIG. 7 may depict a packaging configuration, showing some parts (components) of the bed safety rail of FIG. 1A, but shown in FIG. 7 arranged for shipping in a substantially planarly flat rectangular prism shaped package.

FIG. 7 may depict a packaging configuration, showing some parts (components) of bed safety rail 100 of FIG. 1A, but shown in FIG. 7 arranged for shipping in a substantially planarly flat rectangular prism shaped package. In some embodiments, vertical-safety-rail-member 111 may be one main subassembly; that may be substantially shaped as a rectangular prism that is longer (width 114) than wide (height 115) and wider than thick (thickness 116). In some embodiments, vertical-safety-rail-member 111 may comprise front-panel 118, vertical-frame-member 211, at least one electronics-module 120, and rear-panel 119. In some embodiments, two different L-shaped horizontal-anchor-members 101, may be placed around vertical-safety-rail-member 111 to generally form a rectangular prism shaped structure as shown in FIG. 7, that may be generally flat and of a shape that may be desirable for shipping and for unassembled storage.

In some embodiments, bed safety rail 100 may be in a shipping configuration that is substantially flat; wherein that shipping configuration may comprise a subassembly of the at least one vertical-safety-rail-member 111 and two horizontal-anchor-members 101 selected from the at least one horizontal-anchor-member 101. In some embodiments, the two horizontal-anchor-members 101 may be removably detached from the at least one vertical-safety-rail-member 111 and arranged substantially around a perimeter of the at least one vertical-safety-rail-member 111. See e.g., FIG. 7.

Figure 8:
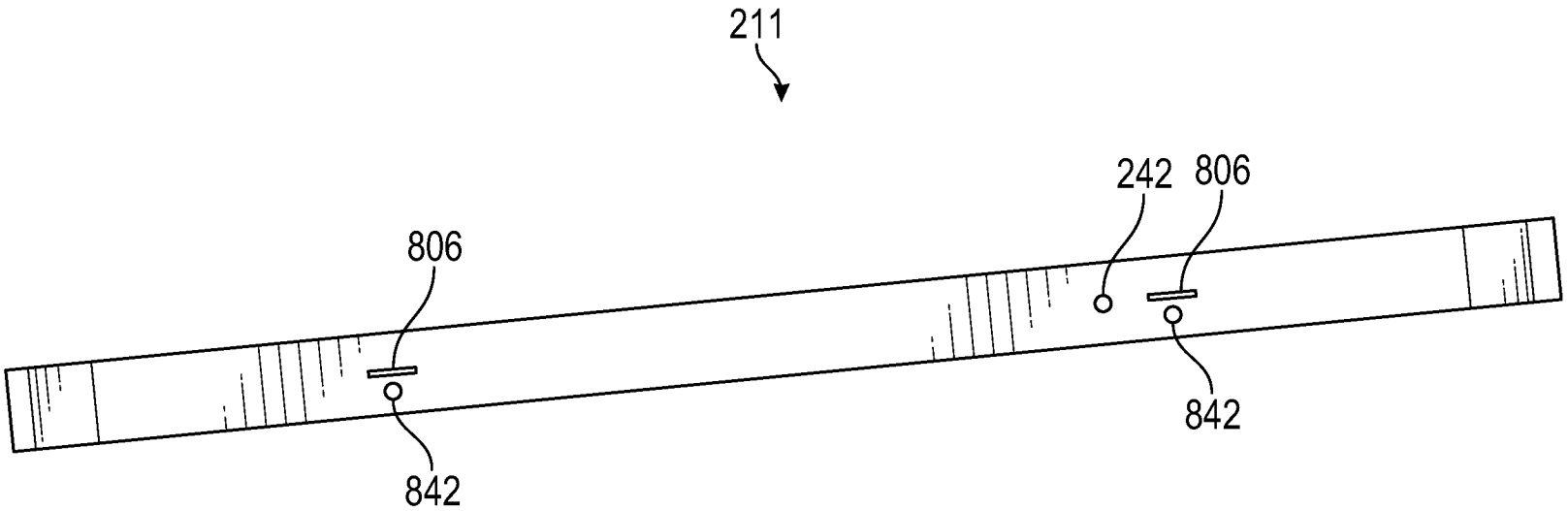
FIG. 8 may depict a bottom view of a vertical-frame-member, which may be a component of the at least one vertical-safety-rail-member.

FIG. 8 may depict a bottom view of a vertical-frame-member 211, which may be a component of the at least one vertical-safety-rail-member 111. A bottom of vertical-frame-member 211 may comprise receiving-slots 806 and adjacent to such receiving-slots 806 may also be seat-fastener-receiving-holes 842. In some embodiments, receiving-slots 806 may be for receiving top portions of vertical-portion 106. In some embodiments, seat-fastener-receiving-holes 842 may be for receiving seat-fasteners 240, such that bracket 241 of vertical-portion 106 may be attached to vertical-frame-member 211.

Note with respect to the materials of construction, it is not desired nor intended to thereby unnecessarily limit the present invention by reason of such disclosure.

Bed safety rails have been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A bed safety rail, wherein the bed safety rail comprises:

at least one horizontal-anchor-member for removably anchoring the bed safety rail to a bed; wherein the at least one horizontal-anchor-member comprises a vertical-portion and a horizontal-portion; wherein the horizontal-portion is an elongate member that is planarly flat, smooth, and free of obstructions, wherein the horizontal-portion is configured for fitting underneath a mattress of the bed; wherein the vertical-portion is substantially perpendicular to the horizontal-portion, such that the vertical-portion extends in a vertical direction away from the horizontal-portion and the horizontal-portion extends in a horizontal direction away from the vertical-portion; wherein the vertical-portion directly transitions into the horizontal-portion in a continuous fashion free of breaks or connections such that the vertical-portion and the horizontal-portion are different regions of a same part, namely, the at least one horizontal-anchor-member; and at least one vertical-safety-rail-member with fixed dimensions, that is substantially vertical with respect to the horizontal-portion of the at least one horizontal-anchor-member; wherein the at least one vertical-safety-rail-member extends in the vertical direction in a manner that is substantially parallel with the vertical-portion; wherein the vertical-portion is attached to a bottom of the at least one vertical-safety-rail-member by a top portion of the vertical-portion being received within and through the bottom of the at least one vertical-safety-rail-member, such that the top portion extends into the at least one vertical-safety-rail-member and past the bottom of the at least one vertical-safety-rail-member in the vertical direction; wherein the at least one vertical-safety-rail-member is fixed with respect to the at least one horizontal-anchor-member when the vertical-portion is attached to the bottom of the at least one vertical-safety-rail-member;

wherein, when in use, the horizontal-portion is a lowest portion of the bed safety rail that provides anchoring to the bed;

wherein when the bed safety rail is in use, the at least one vertical-safety-rail-member is a physical obstruction configured to minimize a user from falling off of the bed.

2. The bed safety rail according to claim 1, wherein the at least one vertical-safety-rail-member comprises a front-panel and a rear-panel; wherein the front-panel and the rear-panel are disposed opposite from each other; wherein a major surface of the front-panel is substantially parallel to a major surface of the rear-panel.

3. The bed safety rail according to claim 2, wherein the front-panel, the rear-panel, or both the front-panel and the rear-panel comprise sufficient ferrous metal to receive removable attachment of a magnet.

4. The bed safety rail according to claim 2, wherein the front-panel, the rear-panel, or both the front-panel and the rear-panel are one or more of: substantially flat, substantially planar, substantially smooth, or substantially non-porous configured to function as a dry erase board.

5. The bed safety rail according to claim 2, wherein the front-panel and the rear-panel are fixedly and oppositely disposed from each other by a predetermined thickness.

6. The bed safety rail according to claim 5, wherein the bed safety rail further comprises at least one clip; wherein the at least one clip is sized to removably attach around the predetermined thickness to the at least one vertical-safety-rail-member; wherein the at least one clip is configured to removably receive a clip-accessory.

7. The bed safety rail according to claim 6, wherein the clip-accessory is selected from one or more of: at least one writing-implement; a cup-holder; a shelf; or a light source.

8. The bed safety rail according to claim 7, wherein the at least one clip comprises a writing-implement-holder configured for removable receiving the at least one writing-implement.

9. The bed safety rail according to claim 1, wherein the at least one vertical-safety-rail-member comprises a vertical-frame-member that is a structural member that is substantially rigid; wherein the vertical-frame-member provides structural rigidity to the at least one vertical-safety-rail-member; wherein the vertical-frame-member provides a structural anchor location, along a bottom horizontal surface of the vertical-frame-member that is the bottom of the at least one vertical-safety-rail-member, for attachment of the vertical-portion of the horizontal-anchor-member to the at least one vertical-safety-rail-member, such that the top portion of the vertical-portion is received into and through the bottom horizontal surface of the vertical-frame-member.

10. The bed safety rail according to claim 1, wherein the bed safety rail further comprises at least one electronics-module; wherein the at least one electronics-module comprises a power-cord and comprises one or more connectors as plug receivers; wherein the power-cord provides electrical power to the one or more connectors; wherein the one or more connectors are female connectors configured for removable receiving one or more of: electrical-power-plugs; USB-plugs, or plugs for receiving at least some of the electrical power.

11. The bed safety rail according to claim 10, wherein the at least one vertical-safety-rail-member comprises at least one panel; wherein the at least one panel comprises at least one electronics-module-cutout, which is a cutout in the at least one panel for receiving the at least one electronics-module.

12. The bed safety rail according to claim 10, wherein the at least one vertical-safety-rail-member comprises a front-panel and disposed opposite a rear-panel; wherein the at least one electronics-module is substantially disposed between the front-panel and the rear-panel.

13. The bed safety rail according to claim 10, wherein the at least one vertical-safety-rail-member comprises a vertical-frame-member that is a structural member that is substantially rigid; wherein the at least one electronics-module is housed within a pocket of the vertical-frame-member, wherein the pocket substantially surrounds all but two opposing sides of the at least one electronics-module.

14. The bed safety rail according to claim 1, wherein the at least one horizontal-anchor-member is at least two separate horizontal-anchor-members, wherein the at least two separate horizontal-anchor-members are fixedly spaced from each other by a constant predetermined spacing, such that the two horizontal-portions extend in a manner that is substantially parallel with each other.

15. The bed safety rail according to claim 14, wherein the at least one vertical-safety-rail-member has a predetermined width and has a predetermined height in the vertical direction; wherein the predetermined width and the predetermined height are substantially orthogonal with respect to each other; wherein the constant predetermined spacing is greater than the predetermined height; wherein the constant predetermined spacing is less than the predetermined width, wherein the predetermined width and the constant predetermined spacing are substantially parallel with each other.

16. The bed safety rail according to claim 1, wherein the horizontal-portion of the at least one horizontal-anchor-member is of a predetermined length.

17. The bed safety rail according to claim 1, wherein the horizontal-portion of the at least one horizontal-anchor-member is of a predetermined length in the horizontal direction; wherein the at least one vertical-safety-rail-member has a predetermined height in the vertical direction; wherein a ratio of the predetermined length to the predetermined height is be from 2.5 to 3.0.

18. The bed safety rail according to claim 1, wherein the at least one horizontal-anchor-member is at least two separate horizontal-anchor-members, wherein the at least two separate horizontal-anchor-members are fixedly spaced from each other by a predetermined spacing; wherein the at least one vertical-safety-rail-member has a predetermined width that runs in a direction that is parallel with the predetermined spacing; wherein a ratio of the predetermined width to the predetermined spacing is from 2.0 to 2.5.

19. The bed safety rail according to claim 1, wherein the bed safety rail comprises a shipping configuration that is an arrangement of the bed safety rail in an at least partially disassembled state configured for shipping; wherein the shipping configuration comprises a subassembly of the at least one vertical-safety-rail-member and two horizontal-anchor-members selected from the at least one horizontal-anchor-member; wherein the two horizontal-anchor-members are removably detached from the at least one vertical-safety-rail-member and arranged substantially around a perimeter of the at least one vertical-safety-rail-member, such that the two horizontal-anchor-members are disposed opposite from each other while substantially bracketing the perimeter of the at least one vertical-safety-rail-member; wherein the shipping configuration has a height that is a thickness of the at least one vertical-safety-rail-member.

* * * * *